US011800894B2

(12) United States Patent
Fernando et al.

(10) Patent No.: US 11,800,894 B2
(45) Date of Patent: Oct. 31, 2023

(54) VENTILATION FOR SHISHA DEVICE

(71) Applicant: PHILIP MORRIS PRODUCTS S.A., Neuchâtel (CH)

(72) Inventors: Felix Fernando, Old Basing (GB); David Cross, Hertfordshire (GB); Terence John Wilby, Herts (GB); Ana Isabel Gonzalez Florez, St-Sulpice (CH); Ian Sparrow, Cambridge (GB)

(73) Assignee: Philip Morris Products S.A., Neuchâtel (CH)

( * ) Notice: Subject to any disclaimer, the term of this patent is extended or adjusted under 35 U.S.C. 154(b) by 65 days.

(21) Appl. No.: 17/049,709

(22) PCT Filed: Apr. 24, 2019

(86) PCT No.: PCT/IB2019/053392

§ 371 (c)(1),
(2) Date: Oct. 22, 2020

(87) PCT Pub. No.: WO2019/207511

PCT Pub. Date: Oct. 31, 2019

(65) Prior Publication Data

US 2021/0059297 A1 Mar. 4, 2021

(30) Foreign Application Priority Data

Apr. 25, 2018 (EP) ..... 18169351

(51) Int. Cl.
*A24F 1/30* (2006.01)
*A24F 1/02* (2006.01)
*A24F 5/04* (2006.01)

(52) U.S. Cl.
CPC ..... *A24F 1/30* (2013.01); *A24F 1/02* (2013.01); *A24F 5/04* (2013.01)

(58) Field of Classification Search
CPC ..... A24F 1/30; A24F 40/485; A24F 5/04
See application file for complete search history.

(56) References Cited

U.S. PATENT DOCUMENTS 4,029,109 A 6/1977 Kahler
10,272,170 B2 4/2019 Philip
(Continued)

FOREIGN PATENT DOCUMENTS

CA 2391728 A1 2/2001
RU 124870 U1 2/2013
(Continued)

OTHER PUBLICATIONS

International Search Report and Written Opinion for PCT/IB2019/053392; issued by the European Patent Office; dated Sep. 12, 2019; 11 pgs.

(Continued)

*Primary Examiner* — Michael H. Wilson
*Assistant Examiner* — Stephanie Lynn Moore
(74) *Attorney, Agent, or Firm* — Mueting Raasch Group

(57) ABSTRACT

A shisha device (10) comprises an aerosol-generating element (11) for receiving an aerosol-forming substrate (12). The shisha device also comprises a vessel (17) spaced from the aerosol-generating element and defining an interior for housing a volume of liquid. The vessel comprises a head space outlet (15). The shisha device also comprises an aerosol conduit (21) positioned between the aerosol-generating element and the interior of the vessel. The aerosol conduit comprises a proximal end portion defining a proximal opening (24) positioned to receive airflow from the aerosol-generating element, a distal end portion defining a distal opening (26) positioned in the interior of the vessel, and a ventilation opening (30) positioned between the proximal and distal end portions. A ratio between the total (Continued)

aperture area of the ventilation opening and a transverse cross-sectional area of the aerosol conduit positioned proximate to the ventilation opening is at most 1:1000. Applying a negative pressure at the head space outlet causes airflow through the aerosol conduit from the proximal opening to the distal opening and causes airflow through the aerosol conduit from the ventilation opening to the distal opening.

16 Claims, 7 Drawing Sheets

(56) References Cited

U.S. PATENT DOCUMENTS

| | | | |
|---|---|---|---|
| 2010/0126517 | A1 | 5/2010 | Groff |
| 2012/0180803 | A1 | 7/2012 | Beloni |
| 2013/0118511 | A1 | 5/2013 | Gonzalez |
| 2015/0122275 | A1 | 5/2015 | Wu |

FOREIGN PATENT DOCUMENTS

| | | | | |
|---|---|---|---|---|
| WO | WO 2014/102092 | A1 | 7/2014 | |
| WO | WO 2015/177255 | A1 | 11/2015 | |
| WO | WO-2018143984 | A1 * | 8/2018 | ..... A24F 1/24 |

OTHER PUBLICATIONS

International Preliminary Report on Patentability for PCT/IB2019/053392 issued by the European Patent Office; dated Jul. 24, 2020; 5 pgs.

European Search Report for EP 18169351.6, issued by the European Patent Office; dated Nov. 13, 2018; 7 pgs.

Russian Decision to Grant and Search Report for RU Application No. 2020137770, issued by the Patent Office of the Russian Federation dated Aug. 5, 2022; 22 pgs. including English translation.

* cited by examiner

VENTILATION FOR SHISHA DEVICE

This application is the § 371 U.S. National Stage of International Application No. PCT/IB2019/053392, filed 24 Apr. 2019, which claims the benefit of European Application No. EP 18169351.6, filed 25 Apr. 2018.

The present disclosure relates to shisha devices and, more particularly, to shisha devices that heat an aerosol-forming substrate without combusting the substrate and that enhance characteristics of generated aerosol using a ventilation opening along an aerosol conduit.

Conventional shisha devices are used to smoke tobacco and are configured such that vapor and smoke pass through a water basin before inhalation by a consumer. Conventional shisha devices may include one outlet or more than one outlet so that the device can be used by more than one consumer at a time. Use of conventional shisha devices is considered by many to be a leisure activity and a social experience.

The tobacco used in conventional shisha devices may be mixed with other ingredients, for example, to increase the volume of the vapour and smoke produced, to alter flavour, or both. Charcoal pellets are typically used to heat the tobacco in a conventional shisha device, which may cause full or partial combustion of the tobacco or other ingredients. Additionally, charcoal pellets may generate harmful, or potentially harmful products, such as carbon monoxide, which may mix with the shisha vapor and smoke and pass through the water basin.

Some conventional shisha devices use electrical heat sources to heat or combust the tobacco to, for example, avoid by-products of burning charcoal or to improve the consistency with which the tobacco is heated or combusted. However, substituting an electric heater for charcoal may result in unsatisfactory production of aerosol in terms of visible smoke or aerosol, total aerosol mass (TAM), or visible smoke or aerosol and TAM.

Conventional electrically-heated shisha devices have been proposed that use one or more nozzles to improve production of aerosol. However, the small diameters necessary to achieve optimal performance may result in unsatisfactory resistance to draw (RTD) values that are substantially larger than in conventional charcoal heated shishas.

It would be desirable to provide a shisha device that produces a satisfactory amount of one or both of visible aerosol and total aerosol mass with a sufficiently low resistance to draw. It would also be desirable to provide a shisha device that heats a substrate in a manner that does not result in combustion by-products.

Various aspects of the disclosure relate to a shisha device that comprises a ventilation opening disposed along an aerosol conduit. One or more ventilation apertures of the ventilation opening are positioned along an aerosol conduit. The aerosol conduit may comprise any one or combination of: a stem pipe, a cooling element, or an accelerating element. The one or more ventilation apertures of the ventilation opening may be positioned along any of: the stem pipe, the cooling element, the accelerating element of the aerosol conduit. In some embodiments, the ventilation opening is positioned along an accelerating element, for example, near a narrow end portion of a nozzle. The ventilation opening may be used to improve aerosol generation through cooling in electrically heated shisha devices or in traditional shisha devices that use partial or full combustion of tobacco or other ingredients.

In one embodiment of the invention, a shisha device comprises an aerosol-generating element for receiving an aerosol-forming substrate and a vessel spaced from the aerosol-generating element. The vessel defines an interior for housing a volume of liquid. The vessel comprises a head space outlet. The shisha device also comprises an aerosol conduit positioned between the aerosol-generating element and the interior of the vessel. The aerosol conduit comprises a proximal end portion defining a proximal opening positioned to receive airflow from the aerosol-generating element, a distal end portion defining a distal opening positioned in the interior of the vessel, and a ventilation opening positioned between the proximal and distal end portions. A ratio between the total aperture area of the ventilation opening and a transverse cross-sectional area of the aerosol conduit positioned proximate to the ventilation opening is at most 1:1000. Applying a negative pressure at the head space outlet causes airflow through the aerosol conduit from the proximal opening to the distal opening and causes ambient air to flow from the ventilation opening, through the aerosol conduit, to the distal opening of the aerosol conduit. Advantageously, using this arrangement, the ambient air mixes with airflow containing generated aerosol as both flow through the aerosol conduit. The mixing of ambient air provides a cooling effect to the airflow containing generated aerosol.

In one or more embodiments, the ventilation opening comprises at least one of:

an ambient air aperture; and one or more ventilation apertures in fluid communication with an ambient air aperture via a ventilation channel.

In one or more embodiments, the aerosol conduit comprises a cooling element positioned proximate to the ambient air aperture or the ventilation channel and configured to cool airflow that flows through the ventilation channel. The cooling element may be an active cooling element, a passive cooling element, or a cooling element employing both active and passive cooling methods. Advantageously, including a cooling element in combination with the ventilation opening may provide control over a temperature of airflow through the aerosol conduit and thus performance of under a wide range conditions. For example, in a country with hot weather, an ambient air temperature of ambient air to be mixed with airflow containing generated aerosol may be 40° C., which may not provide a desired cooling effect for aerosol production. An active cooling element may be used to cool the ambient air below the ambient air temperature to provide the desired cooling effect.

In one or more embodiments, the aerosol conduit comprises an accelerating element positioned along the aerosol conduit and configured to accelerate aerosol that flows through the accelerating element.

In one or more embodiments, the accelerating element comprises one or more ventilation apertures of the ventilation opening.

In one or more embodiments, the ventilation opening is positioned in a relatively narrow end portion of the accelerating element. Advantageously, positioning the ventilation opening in a relatively narrow end portion of the accelerating element may allow provide a controlled ratio of dilution of the aerosol with ambient air entering the aerosol conduit.

In one or more embodiments, the accelerating element comprises a tapered portion and the relatively narrow end portion of the accelerating element is a relatively narrower portion of the tapered portion.

In one or more embodiments, the ventilation opening comprises one or more ventilation apertures forming a ring-shaped opening.

In one or more embodiments, the aerosol conduit comprises a stem pipe comprising the one or more ventilation apertures of the ventilation opening. In one or more embodiments, the stem pipe may have a length of approximately 0.30 metre. In one or more embodiments, the stem pipe may have a maximum length of 1 metre.

In one or more embodiments, the aerosol conduit comprises a ventilation chamber positioned proximate to one or more ventilation apertures of the ventilation opening.

In one or more embodiments, the ventilation chamber comprises a vortex element. In one or more embodiments, the vortex element may comprise a thread like geometry. Advantageously, the vortex element increases surface area of the cooling block and increases turbulent air flow by increasing likelihood of collisions between the ambient air and the cooling block. This helps to cool ambient air before it enters the aerosol conduit through the ventilation opening.

In one or more embodiments, the ventilation channel comprises a vortex element. The vortex element may comprise a thread like geometry. Advantageously, the vortex element increases surface area of the cooling block and increases likelihood of collisions between the ambient air and the cooling block. This helps to cool ambient air before it enters the aerosol conduit through the ventilation opening.

In one or more embodiments, the aerosol conduit comprises a cooling element configured to cool aerosol that flows through the aerosol conduit. In one or more embodiments, the cooling element is configured to cool ambient air that flows through the cooling element. In one or more embodiments, the cooling element is configured both to cool aerosol that flows through the aerosol conduit and to cool ambient air that flows through the cooling element.

In one or more embodiments, the cooling element defines at least one of an ambient air aperture of the ventilation opening and a ventilation chamber adjacent to a ventilation aperture of the ventilation opening.

In one or more embodiments, the ventilation opening comprises one or more ventilation apertures having a total aperture area between 0.2 $mm^2$ and 7 $mm^2$.

In one or more embodiments, the transverse cross-sectional area is located in line with a central point of the ventilation opening.

In one or more embodiments, the aerosol-generating element and the centre of the ventilation opening are separated by no more than 30 mm.

Advantageously, the shisha devices described herein may provide a low resistance to draw (RTD) while still achieving sufficient production of aerosol by lowering the temperature of aerosol-entrained air downstream of the aerosol-generating element and upstream of the vessel interior. In particular, positioning a ventilation opening to mix some amount of ambient air with the aerosol-entrained air may facilitate the production of aerosol. The shisha devices described herein may include a cooling element to even further enhance aerosol production. In particular, the cooling element may advantageously be used to pre-cool airflow entering the ventilation opening, especially in hot climates. Using a shisha device described herein may allow the minimum diameter of a nozzle aperture to be enlarged, which may facilitate a lower RTD compared to a shisha device without the ventilation opening. As a result, the shisha devices described herein may produce substantially more visible aerosol, deliver substantially more total aerosol mass (TAM), or produce substantially more visible aerosol and deliver substantially more TAM than similar shisha devices without the ventilation opening. Users of such devices may have an experience more typical of a conventional shisha device in which an aerosol generating substrate is combusted with charcoal, particularly in terms of aerosol production and RTD, but without combustion by-products of the charcoal. In addition, if the shisha device is configured to sufficiently heat an aerosol generating substrate to produce an aerosol, without combusting the aerosol, combustion by-products of the aerosol generating substrate may also be avoided.

All scientific and technical terms used herein have meanings commonly used in the art unless otherwise specified. The definitions provided herein are to facilitate understanding of certain terms used frequently herein.

The term "aerosol-forming substrate" refers to a device or substrate that releases, upon heating, volatile compounds that may form an aerosol to be inhaled by a user. Suitable aerosol-forming substrates may include plant-based material. For example, the aerosol-forming substrate may include tobacco or a tobacco-containing material containing volatile tobacco flavour compounds, which are released from the aerosol-forming substrate upon heating. In addition, or alternatively, an aerosol-forming substrate may include a non-tobacco containing material. The aerosol-forming substrate may include homogenized plant-based material. The aerosol-forming substrate may include at least one aerosol former. The aerosol-forming substrate may include other additives and ingredients such as flavourants. In some embodiments, the aerosol-forming substrate comprises a liquid at room temperature. For example, the aerosol-forming substrate may comprise a liquid solution, suspension, dispersion or the like. In some embodiments, the aerosol-forming substrate comprises a solid at room temperature. For example, the aerosol-forming substrate may comprise tobacco or sugar. Preferably, the aerosol-forming substrate comprises nicotine.

The term "tobacco material" refers to a material or substance comprising tobacco, which comprises tobacco blends or flavoured tobacco, for example.

As used herein, the term "aerosol" as used when discussing a flow of aerosol, may refer to aerosol, air containing aerosol or vapour, or aerosol-entrained air. Air containing vapour may be a precursor to air containing aerosol, for example, after being cooled or after being accelerated.

As used herein, the term "cooling" refers to a reduction of internal energy in a system, which may be achieved by heat transfer but also by work done by the system.

As used herein, the term "ventilation aperture" refers to an aperture on an aerosol conduit of the shisha device. The ventilation aperture is adjacent to and in fluid communication with an airflow channel through the aerosol conduit and may directly open to the airflow channel. The ventilation aperture may be relatively small compared to a transverse cross-sectional area of the airflow channel of the aerosol conduit.

As used herein, the term "ambient air aperture" refers to an aperture on a component of the shisha device. The ambient air aperture is adjacent to an external environment of ambient air and directly opens to the external environment. The ambient air aperture may be remote from the aerosol conduit. The ambient air aperture may be in fluid communication with the ventilation aperture, for example, via one or both of a ventilation channel and a ventilation chamber.

As used herein, the term "ventilation opening" refers to one or more structures of the shisha device used to facilitate introducing ventilation air into the airflow channel of the aerosol conduit. The ventilation opening may encompass the ventilation aperture and any auxiliary channels, chambers, or additional apertures, such as the ambient air aperture, leading from the ventilation aperture to the external environment of ambient air.

Having defined certain frequently-used terms above, the shisha device of the present disclosure will be described herein in more detail. In general, a shisha device comprises a ventilation opening disposed along an aerosol conduit. The ventilation opening may contribute to providing enhanced aerosol characteristics, such as a higher TAM, a lower RTD, or both a higher TAM and lower RTD. Resistance to draw, or RTD, is the pressure required to force air through the full length of the object under test at the rate of 17.5 ml/sec at 22° C. and 101 kPa (760 Torr). RTD is typically expressed in units of $mmH_2O$ and is measured in accordance with ISO 6565:201 1. Preferably, less than or equal to 38 mmWG to provide a shisha experience similar to a conventional shisha device.

The shisha device may comprise an aerosol-generating element. The aerosol-generating element may be used with an aerosol-forming substrate to produce aerosol. In particular, the aerosol-generating element may receive and heat the aerosol-forming substrate to generate aerosol. The aerosol-forming substrate may be heated, but not burned, by the aerosol-generating element. The aerosol-generating element may comprise a heating element. The heating element may comprise an electric heater.

In some embodiments, the aerosol-generating element may comprise features of a conventional shisha device, such as any of: a bowl for receiving an aerosol-forming substrate, a cover plate for covering the bowl, foil for covering the bowl, and at least one charcoal pellet for heating the aerosol-forming substrate.

A shisha device may comprise a vessel. The vessel may define an interior. The vessel may be configured to contain liquid. In particular, the interior of the vessel may contain a volume of liquid.

Air may be flowed through the aerosol-generating element to draw aerosol from the aerosol-generating element through an aerosol conduit. The aerosol conduit may define an airflow channel. The aerosol, which may be altered by being pulled through the liquid, may exit the shisha device through a head space outlet of the vessel. Air may flow through the aerosol conduit by application of a negative pressure at the head space outlet. The source of negative pressure may be suction or puffing of a user. In response, aerosol may be drawn through the aerosol conduit, through the liquid contained in the interior of the vessel. The user may suction a mouthpiece in fluid communication with the head space outlet to generate or provide the negative pressure at the head space outlet or mouthpiece.

During use, the aerosol conduit may be in fluid communication with a head space outlet through some liquid. The aerosol conduit may start proximate, or adjacent, to an aerosol-forming substrate. The aerosol conduit may end in the interior of the vessel or continue, for example, at least to the head space outlet or mouthpiece.

The aerosol-generating element is in fluid communication with the interior of the vessel. In particular, the aerosol conduit may comprise an airflow channel that at least partially defines the fluid communication from the aerosol-generating element to the interior of the vessel. Various components may be disposed along the airflow channel, or aerosol conduit, to enhance characteristics of aerosol flowing through to the head space outlet to the user.

The term "downstream" refers to a direction along the aerosol conduit toward the interior of the vessel from the aerosol-generating element. The term "upstream" refers to a direction opposite to the downstream direction, or a direction along the aerosol conduit toward the aerosol-generating element from the interior of the vessel.

The aerosol conduit is positioned between the aerosol-generating element and the interior of the vessel. The aerosol conduit may comprise one or more components along the aerosol conduit. The aerosol conduit comprises a proximal end portion defining a proximal opening positioned to receive airflow from the aerosol-generating element. The aerosol conduit comprises a distal end portion defining a distal opening positioned in the interior of the vessel. The distal end portion of the aerosol conduit may extend into a volume of liquid in the interior of the vessel during use of the shisha device.

The aerosol conduit may be described as defining a longitudinal axis extending through the proximal end portion and the distal end portion. A lateral direction may be defined orthogonal to the longitudinal axis. For example, a cross-section, circumference, width, or diameter of the aerosol conduit may be defined in the lateral direction, or in a plane orthogonal to the longitudinal axis.

The aerosol conduit comprises a ventilation opening positioned between the proximal and distal end portions of the aerosol conduit. In general, airflow through the aerosol conduit will flow from the aerosol-generating element to the interior of the vessel. Applying a negative pressure at the head space outlet causes airflow through the aerosol conduit from the proximal opening to the distal opening and causes airflow through the aerosol conduit from the ventilation opening to the distal opening.

In some embodiments, airflow may enter an aerosol-forming substrate receptacle of the shisha device, go along a cartridge of the aerosol-forming substrate, then to the bottom of the cartridge, then to the bottom of the receptacle. The airflow may then pass through the aerosol-forming substrate may become entrained with aerosol. Aerosol-entrained air may depressurize upon passing through one or more accelerating elements (e.g., nozzles). The aerosol-entrained air may mix with ventilation airflow from the ventilation opening resulting in a temperature drop of the aerosol-entrained air that may enhance the aerosolization process. The mixed aerosol-entrained air (e.g., cooled air) then travels optionally through an accelerating element, through a stem pipe, into the vessel (e.g., water basin), and then may be inhaled by the user.

The shisha device may comprise an accelerating element. The accelerating element may be positioned along the aerosol conduit, such as along the airflow channel of the aerosol conduit. In particular, the accelerating element may be positioned along the aerosol conduit. The accelerating element may integrally form part of the airflow channel or aerosol conduit. The accelerating element may be configured to accelerate aerosol that flows through the accelerating element.

The accelerating element is configured to accelerate aerosol that flows through the accelerating element along the airflow channel or aerosol conduit. The accelerating element may be disposed downstream from the aerosol-generating element along the airflow channel or aerosol conduit. The accelerating element may be disposed between the aerosol-generating element and the vessel. Accelerating the aerosol may result in a pressure drop and spraying-seeding effect, which may be explained by the Venturi effect or the Bernoulli effect, and which may increase TAM. Further, the accelerating element may be positioned adjacent to, or as close as possible, to a deceleration chamber, or deceleration portion of the stem pipe, which may promote rapid cooling for aerosol production.

The accelerating element may be of any suitable shape to provide acceleration of aerosol, such as a nozzle shape. The nozzle may be tapered from a wide end portion to a narrow end portion to facilitate acceleration of the aerosol, or aerosol-entrained air, through a small diameter aperture. The wide end portion is typically proximal, and the narrow end portion is typically distal. The accelerating element may be described as a nozzle. In some embodiments, only part of the accelerating element is tapered. The ventilation opening may be positioned on the tapered portion, the non-tapered portion, or both the tapered and non-tapered portions of the accelerating element. The accelerating element may be formed of any suitable material capable of being shaped to provide acceleration, such as an epoxy resin or aluminium. The epoxy resin may be a high temperature epoxy resin.

The shisha device may comprise a cooling element. The cooling element may be disposed along the airflow channel or aerosol conduit. The cooling element may integrally form part of the airflow channel or aerosol conduit. The cooling element is configured to cool aerosol in the airflow channel, particularly air that flows through or past the cooling element. The cooling element may be disposed downstream from the aerosol-generating element along the airflow channel. In particular, the cooling element may be disposed between the aerosol-generating element and the end of the airflow channel, or at least between the aerosol-generating element and the vessel. Further, the cooling element may be positioned adjacent to, or as close as possible, to a deceleration chamber, or deceleration portion of the stem pipe, which may promote rapid cooling for aerosol production. The cooling element may utilize passive cooling, active cooling, or both. The cooling element may comprise a conduit of thermally conductive material. The cooling element may be configured to cool aerosol that flows through the aerosol conduit.

The cooling element may be configured to cool, or at least regulate, ambient air that flows through the cooling element, which may facilitate aerosol production in a variety of geographic locations and climatic seasons. A passive cooling element may provide cooling down to an ambient temperature. An active cooling element may provide cooling, in some cases, below the ambient temperature. The cooling element may be configured both to cool aerosol that flows through the aerosol conduit and to cool ambient air that flows through the cooling element.

The cooling element may be used in combination with an air accelerating element. The air accelerating element may be integrally formed with at least one of the cooling element or a chamber. The chamber may be a deceleration chamber for aerosol. The cooling element may be at least partially or entirely disposed upstream from the chamber.

The cooling element may be configured to cool aerosol before or during acceleration by the accelerating element. The accelerating element may be disposed downstream of a cooling element. In particular, the accelerating element may be disposed between the cooling element and the vessel. Cooled aerosol may be received by the accelerating element.

The cooling element and the accelerating element may be an integral or unitary piece. However, the cooling element and the accelerating element may also be separate pieces. The cooling element may operably couple to the accelerating element to allow air in the airflow channel or aerosol conduit to flow through both the cooling element and the accelerating element. The cooling element and the accelerating element may together form at least part of the aerosol conduit.

In general, cooling down the cavity of the cooling element or the airflow channel of the aerosol conduit may allow a higher production of aerosol compared to using a device which does not incorporate such aerosol cooling. The cooling may enhance condensation of the aerosol, to increase visible aerosol, total aerosol mass (TAM), or visible aerosol and TAM. The cooling element may be integrally formed with an accelerating element, such as a nozzle, disposed along the airflow channel or aerosol conduit. The combination of cooling and accelerating the aerosol may result in substantial increases in visible aerosol, TAM, or visible aerosol and TAM.

A chamber may be disposed along the airflow channel or aerosol conduit. The chamber may be configured to decelerate air. Aerosol may be formed in response to decelerating aerosol-entrained air. The chamber may be disposed downstream from the aerosol-generating element. In particular, the chamber may be disposed between the aerosol-generating element and the vessel, or more particularly, between the accelerating element and the vessel.

The chamber may be disposed downstream from the cooling element. The chamber may also be disposed downstream from the accelerating element. The accelerating element may be at least partially or entirely disposed in the chamber. In some embodiments, the accelerating element forms an inlet of the chamber. The accelerating element may be integrally formed with the chamber. The cooling element may be at least partially or entirely disposed upstream from the chamber. In some embodiments, the cooling element may be integrally formed with the accelerating element to form a nozzle, which may extend at least partially into the chamber.

The aerosol conduit may be used to reduce the air temperature of aerosol-entrained air flowing through the aerosol conduit. In particular, the average temperature in the nozzle cavity in between puffs may be about 40° C. Ventilation air flow through the ventilation opening of the aerosol conduit may be used to mix with the aerosol-entrained air. Preferably, the ventilation air flow does not exceed the temperature of the aerosol-entrained air and may be used to produce a temperature drop in the aerosol-entrained air. Preferably, the temperature of the ventilation air flow is about 20° C. or less.

The ventilation opening may comprise one or more ventilation apertures. One or more ventilation apertures of the ventilation opening may be formed in a sidewall of the aerosol conduit, such as the sidewall of a stem pipe or cooling element. Where more than one aperture is provided, the apertures may be of uniform size or non-uniform size. Where more than one aperture is provided, the apertures may be of uniform or non-uniform shape. Where more than one aperture is provided, the apertures may be uniformly distributed or non-uniformly distributed. Where more than one aperture is provided, the apertures may be arranged in a ring shape about a circumference or perimeter of the sidewall of the aerosol conduit. The aerosol conduit may include a stem pipe that may be used to extend into liquid in the vessel interior. In some embodiments, the ventilation opening may be positioned upstream of, or proximal to, the stem pipe. In some embodiments, the ventilation opening may be positioned on the stem pipe. A sidewall of the stem pipe may define one or more ventilation apertures.

The one or more ventilation apertures may be used to form a ring-shaped opening. The ring-shaped opening may extend around some or all the lateral circumference of the aerosol conduit. Using the ring-shaped opening may provide a more even, or homogenous, mixing of aerosol-entrained air with ventilation air compared to a single aperture that does not extend around the lateral circumference of the aerosol conduit. In some embodiments, the ring-shaped opening may extend around at least about 90 degrees, at least about 180 degrees, at least about 270 degrees, or about 360 degrees.

The one or more ventilation apertures of the ventilation opening may define a total aperture area. The size of the ventilation apertures may vary depending on the particular application. In general, using smaller areas may block over time requiring frequent cleaning, whereas larger areas may impact the aerosol quality due to excessive dilution. In some embodiments, the total aperture area may range from about 0.2 $mm^2$ to about 7 $mm^2$. In some embodiments, total aperture area ranges from about 0.2 $mm^2$ to about 1 $mm^2$. In one embodiment, total aperture area is equal to about 0.8 $mm^2$.

Without any ventilation apertures, the aerosol-entrained may flow at a rate of, e.g., about 11.6 L/min through the shisha device. The flowrate may decrease with increasing area of the ventilation aperture. A reduction of flowrate of about 20% (from about 11.6 L/min to about 9.2 L/min) may negatively impact aerosol production due to excessive dilution. Preferably, the one or more ventilation apertures are sized such that the reduction of the flowrate does not exceed about 20% reduction. In one embodiment, the reduction in flowrate is about 2% (from about 11.6 L/min to about 11.4 L/min) corresponding to a total aperture area of about 0.8 $mm^2$.

Various types of ventilation apertures may be included in the ventilation opening. The ventilation opening may include an ambient air aperture. The ambient air aperture may be in fluid communication with ambient air. In particular, the ambient air aperture may be positioned adjacent to the ambient environment. The ventilation opening may include a ventilation aperture in fluid communication with an ambient air aperture via a ventilation channel. For example, the ventilation channel may extend, at least partially, from the ventilation aperture to the ambient air aperture.

External condensation nuclei may be added into the ventilation airflow, for example, into airflow entering the ventilation opening. Condensation nuclei may be used to increase vapor condensation. Without intending to be bound by theory, it is believed that condensation nuclei promote a process of heterogeneous nucleation of the vapor as the vapor cools to form an aerosol, which increases one or both of visible aerosol and total aerosol mass.

As used herein, the term "condensation nuclei" refers to any particulate matter that may act as a seed or a nucleation site on or about which vapor particles may condense to form solid particles or liquid droplets in the form of an aerosol. The condensation nuclei may be solid particles, liquid droplets, or a combination of solid particles and liquid droplets.

Condensation nuclei having a size in a range from about 0.01 micrometres to about 5 micrometres may be suitable for promoting heterogeneous nucleation, and thus may generate one or both of increased visible aerosol and total aerosol mass. The condensation nuclei may have an average size of between about 0.01 micrometres to about 5 micrometres, between about 0.05 micrometres to about 2 micrometres, between about 0.1 micrometres to about 0.3 micrometres or about 0.2 micrometres.

The condensation nuclei may comprise, for example, sodium chloride (NaCl), potassium chloride (KCl), a carbon particle, or any other suitable particulate matter.

One or more ventilation apertures may be positioned in a reduced volume, or chamber. In some embodiments, the aerosol conduit may at least partially define a ventilation chamber positioned proximate to one or more ventilation apertures of the ventilation opening. The use of a chamber may be used to increase the ratio of lower-temperature ventilation air and higher temperature aerosol-entrained air. In some embodiments, the ventilation chamber is positioned close to the narrow end portion of the accelerating element (e.g., exit orifice of the nozzle).

The ventilation chamber may be used to provide an interface to one or more ventilation apertures that is independent of stem pipe or nozzle orientation. For example, when using the ventilation chamber, a ventilation aperture on a stem pipe need not be radially oriented to match a ventilation channel on a cooling block, which may provide a more ergonomic orientation for the stem pipe relative to the cooling block. The ventilation chamber may surround the ventilation aperture. The ventilation aperture may be on the stem pipe or nozzle. The ventilation chamber may be in fluid communication with an ambient air aperture remote to the ventilation aperture.

Alternatively, or in addition to using the ventilation chamber, the cooling element and the accelerating element may be integrated. For example, a cooling block may form a nozzle. A ventilation aperture on the nozzle may be pre-aligned to a ventilation channel on the cooling block. A first stem pipe may connect, in fluid communication, the cooling block to an aerosol-generating element. A second stem pipe may connect, in fluid communication, the cooling block to a vessel. The first stem pipe may be shorter than the second stem pipe. The cooling block may include air-sealed connectors to each of the stem pipes.

In some cases, aerosol-entrained air may condense on walls of the aerosol conduit. Air entering the aerosol conduit through the ventilation opening in a sufficiently homogeneous manner may help to prevent or reduce condensation on the internal walls of the aerosol conduit. The ventilation opening may function as a funnel guide, to guide the ventilation air stream along the internal walls of the aerosol conduit. The ventilation air stream may buffer the aerosol-entrained air from the internal walls. The ventilation opening may comprise a ring-shaped opening or a plurality of apertures. This may help the ventilation opening to function as a funnel guide.

The accelerating element may define one or more ventilation apertures of the ventilation opening. In one embodiment, one or more ventilation apertures of the ventilation opening are positioned on the accelerating element, such as a nozzle.

In some embodiments, one or more ventilation apertures of the ventilation opening are positioned in the narrow end portion of the accelerating element.

In some embodiments, a ratio between the total aperture area of the ventilation opening and a transverse cross-sectional area of the aerosol conduit positioned proximate to, or adjacent, the ventilation opening may be at most about 1:1000. The transverse cross-sectional area of the aerosol conduit used in comparison to the total aperture area may be located, for example, at a wide end portion of the accelerating element or the stem pipe. The transverse cross-sectional area may be located in line with a central point of the ventilation opening.

The cooling element may define one or more ventilation apertures of the ventilation opening. In one embodiment, one or more ventilation apertures of the ventilation opening are positioned on the cooling element. The cooling element may be upstream of the accelerating element.

Ventilation air entering the ventilation opening may be pre-cooled by the cooling element. The cooling element may comprise an active cooling element, which may advantageously improve control over the pre-cooling of ventilation air. The cooling element may be positioned proximate to the ambient air aperture or the ventilation channel. In some embodiments, the cooling element may at least partially define the ventilation channel. In one embodiment, the aerosol conduit comprises a cooling element positioned proximate to the ambient air aperture or the ventilation channel and configured to cool airflow that flows through the ventilation channel. In particular, the cooling element may define at least one of a ventilation aperture of the ventilation opening and a ventilation chamber adjacent to a ventilation aperture of the ventilation opening.

The cooling element may comprise a passive cooling element, an active cooling element, or a passive cooling element and an active cooling element. In some embodiments, the cooling element comprises a nozzle formed of a thermally conductive material that defines one or multiple ventilation apertures. In some embodiments, the cooling element comprises a cooling block defining one or multiple narrow air channels. In some embodiments, the cooling element comprises a thermoelectric device such as, a Peltier element to actively cool the incoming ambient air.

In some embodiments, the cooling element may interface with the aerosol conduit. A sealing gasket may be positioned to seal the aerosol conduit from the cooling element. For example, a sealing gasket may be positioned to seal the stem pipe from the cooling block. A ventilation aperture may be provided in the cooling element, which ventilation aperture may be in fluid communication with the ambient air aperture via a ventilation channel. By providing a sealing gasket around the aerosol conduit from the cooling element, ambient air may advantageously be guided to flow through ventilation aperture, along the ventilation channel to the ambient air aperture.

The ventilation opening may be positioned close to the aerosol-generating element along the aerosol conduit. For example, the aerosol-generating element and the centre of the ventilation opening may be separated by no more than 30 mm. Positioning the ventilation opening close to the aerosol-generating element may increase the temperature gradient of aerosol-entrained air, which may facilitate enhanced aerosol production. In some embodiments, the ventilation opening is positioned as close as possible to the aerosol-generating element in order to steepen the cooling rate of aerosol-entrained air.

One or more components of the shisha device forming the airflow channel may have an effect on a resistance to draw (RTD) of the shisha device. The RTD may be related to how easily the user may draw aerosol through the airflow channel of the shisha device, through the liquid, through the headspace outlet to an optional mouthpiece. One or more components of the shisha device forming, defining, appended to or intercepting the airflow channel may have a resistance to draw (RTD). The RTD of the accelerating element may at least partially contribute to the RTD of the airflow channel. The accelerating element may define a more restrictive cross-sectional diameter through the airflow channel, for example, compared to the chamber and the cooling element. The accelerating element may define the RTD of the airflow channel. In particular, the RTD may be less than or equal to about 45 millimetres, water gauge (mmWG), preferably equal to about 38 millimetres water gauge or less.

In general, the cooling element may operate by being heated by the aerosol by convection and transferring the heat away from the air. The cooling element may make use of various passive or active techniques to accomplish cooling of the aerosol.

The cooling element may be positioned proximate, or adjacent, to the ventilation opening. In some embodiments, the cooling element may surround the ventilation opening. In some embodiments, the cooling element may provide pre-cooled ventilation air to the ventilation opening. For example, airflow may be arranged so as to pass through or adjacent to the cooling element before entering the ventilation opening. In some embodiments, the cooling element may be provided upstream or downstream of the ventilation opening. In some embodiments, the cooling element may at least partially define the ventilation opening. Portions of the ventilation opening may be formed in the cooling element, such as any of: a ventilation chamber, a ventilation channel, and an ambient air aperture. In some embodiments, more than one cooling element may be provided.

As used herein, the term "passive cooling" refers to cooling without additional power consumption or power source. The term "active cooling" refers to cooling using additional power consumption or power source. The cooling element may be operably coupled to the power source, such as a power supply or battery, to provide active cooling. The effectiveness of cooling, especially passive cooling, may be affected by certain conditions, such as ambient temperature, temperature gradient, heat transfer ability, humidity, and ventilation.

Components of the cooling element may comprise at least one of: a conduit comprising a thermally conductive material, a heatsink, a heat pump, a fan, a cooling receptacle having an interior volume for liquid disposed outside of the airflow channel, a water block, and a liquid pump. Passive components may comprise at least one of the conduit, the heatsink, the cooling receptacle, and the water block. Active components may comprise the heat pump, the fan, and the liquid pump. Each component may be thermally coupled to the aerosol flowing through the cooling element. More than one of these components may be used together to further enhance cooling.

The conduit of the cooling element may comprise a material configured to facilitate passive cooling of aerosol flowing through a cavity of the conduit. The conduit may comprise a thermally conductive material, which may be used to draw heat away from the aerosol. The conduit may be heated by the aerosol. The thermal diffusivity of the material may be equal to or greater than about $10^{-6}$ $m^2/s$, $10^{-5}$ $m^2/s$, about $5\times10^{-5}$ $m^2/s$, or even about $10^{-4}$ $m^2/s$.

Non-limiting examples of thermally conductive material include aluminium, which has a thermal diffusivity of $9.7\times10^{-6}$ $m^2/s$, and copper.

In some embodiments, a portion of the conduit forms the accelerating element. For example, the conduit may be a nozzle comprising the cooling element and the accelerating element.

Air outside of the aerosol conduit flowing past the aerosol conduit may draw heat away from the aerosol conduit or airflow channel. This cooling airflow may be provided by the design of the shisha device. The shisha device may comprise a cooling airflow channel extending from an ambient air source (for example, the ambient environment) to the cooling element. In one example, the cooling element may heat air that rises upward and causes a flow of the ambient air through the cooling airflow channel and past the cooling element. Proper ventilation design of the shisha device may facilitate this airflow and may provide a passive fan. In another embodiment, the cooling airflow may be facilitated by the puffing of the user. The cooling airflow channel may be designed to extend to the mouthpiece. The puffing of the user may facilitate ambient air to flow through the cooling airflow channel and past the cooling element. The same puffing of the user to generate the cooling airflow may also draw the aerosol through the airflow channel of the aerosol conduit.

The air heated by the cooling element may be used to provide preheated air to the aerosol-generating element, which may facilitate improved operation of the aerosol-generating element. For example, the ambient air may be in fluid communication with the cooling element through the cooling airflow channel. The cooling element may heat the ambient air when cooling the aerosol. The heated air may be in fluid communication with the aerosol-generating element. In particular, the heated air may be drawn through the aerosol-generating element to produce more aerosol, which may then be drawn into the airflow channel of the aerosol conduit.

Typically, heaters increase the temperature of the substrate from the outside to the inside, which may take a long time and may produce a thermogradient through the substrate. By passing a mass of hot air along the substrate, the temperature of the substrate may be increased more quickly and may flatten the thermogradient.

Using thermally conductive material may not be limited to the cooling element. For example, the accelerating element may be formed of the thermally conductive material. In some embodiments, both the conduit and the accelerating element are formed of thermally conductive material. For example, conduit and the accelerating element may be integrally formed together.

In some embodiments, the conduit of the cooling element may be formed of a material that is not thermally conductive or has a low thermal conductivity. For example, the conduit may be formed of an epoxy resin. Other components of the cooling element may be used to provide the cooling effect.

Various types of heatsinks may be used. The heatsink may be formed of thermally conductive material. The heatsink may be a fringed heatsink. For example, the fringed heatsink may include a plurality of fins. One or more fins may have a surface area of at least 225 $mm^2$. The fins may be relatively thin. One or more of the fins may have a thickness of at most 0.5 mm. The cooling airflow outside of the aerosol conduit may draw heat away from the heatsink. The heatsink may be a heat pipe. The heat pipe may include a working fluid that may be subjected to vaporization and then condensation.

The heatsink may be used in combination with the conduit. In particular, the heatsink may be thermally coupled to the aerosol through the conduit. The heatsink may be disposed outside of the conduit. For example, the heatsink may at least partially or entirely surround a portion of the conduit. The heatsink may draw heat away from the conduit.

Any suitable heat pump may be used. In one example, the heat pump may include a thermoelectric element that may use electrical energy to drive cooling. The thermoelectric element may be particularly suitable for use with an electric power source. In some embodiments, the thermoelectric element is a Peltier element. The heat pump may have a heated side and a cooled side and be configured to transfer heat from the cooled side to the heated side in a direction away from the aerosol. The cooling airflow outside of the aerosol conduit may draw heat away from the heated side of the heat pump.

The heat pump may be used in combination with at least one of the conduit and the heatsink. For example, the heat pump may be coupled to the conduit, the heatsink, or both. In particular, the cooled side of the heat pump may be disposed adjacent to the heatsink to cool ambient air. The cooled air may then pass flow past the heatsink, for example, through the fins to provide efficient cooling.

Any suitable fan may be used. The fan may facilitate movement of the cooling airflow outside of the aerosol conduit. The fan may be powered by an electric power source. The fan may be used in addition to, or as an alternative to, generating the cooling airflow using the puffing of the user.

The fan may be used in combination with at least one of the conduit, the heatsink, and the heat pump. In one example, the fan may direct the cooling airflow past the heatsink, for example, through the plurality of fins coupled to the conduit. In another example, the fan may be selectively activated. The shisha device may include a temperature sensor and a controller. The temperature sensor may be thermally coupled to the heated side of the heat pump. The fan may be activated in response to the sensed temperature exceeding a temperature threshold. Selective activation of the fan may provide improved temperature. For example, selective activation may help improve cooling only when needed (for example, to save power) or may help prevent overheating of the aerosol-generating element (for example, to prevent burning of the aerosol-forming substrate).

Various types of cooling receptacles may be used. The interior volume of the cooling receptacle may be configured to contain liquid. The liquid may be disposed adjacent to the airflow channel or aerosol conduit. In particular, the liquid in the cooling receptacle may not be disposed in the path of the aerosol from the aerosol-generating element to the head space outlet. The interior volume of the cooling receptacle may not be in fluid communication with the interior of the vessel. However, in one or more embodiments, the interior volume may be in fluid communication with the interior of the vessel.

The interior volume of the cooling receptacle may be greater than or equal to about 250 ml. Non-limiting examples of liquid used in the cooling receptacle include water and ethylene glycol.

The liquid may be manually disposed by the user into the interior volume. The internal volume may also be filled using other techniques, such as using the liquid pump or through capillary action, using liquid from another source, such as the vessel. Using such techniques may simplify operation of the shisha device. The user may need to fill only the vessel, which will also provide liquid to the cooling receptacle. Capillary action may allow filling without additional power consumption.

In general, the cooling receptacle may the aerosol when the aerosol heats the liquid. The cooling receptacle may then transfer heat away from the liquid in various ways.

One type of cooling receptacle may include one or more ports to allow liquid to flow in or out of the interior volume. Cool liquid may be cycled into the interior volume from an external source. Heated liquid may be cycled out of the interior volume.

Another type of cooling receptacle may include a thermally conductive wall around the interior volume. The thermally conductive wall may be formed of thermally conductive material. The cooling airflow outside of the aerosol conduit may draw heat away from the thermally conductive wall.

Yet another type of cooling receptacle may be at least partially porous. The cooling receptacle may include a porous wall that allows liquid to evaporate through the wall. Non-limiting examples of porous material include porous clay and foamed silica.

Still another type of cooling receptacle may be described as a "pot-in-pot" cooling receptacle, which also allows liquid to evaporate. The pot-in-pot cooling receptacle may include an inner wall and an outer wall. The outer wall may define the interior volume for containing liquid and an opening to allow for the escape of vapor. The inner wall may be porous, formed of porous material, and be disposed inside the outer wall. The porous first wall may allow for evaporation of liquid through a surface of the inner wall, which may escape the cooling receptacle as vapor through the opening defined by the outer wall.

The effectiveness of the pot-in-pot cooling receptacle may depend on temperature and humidity of the ambient environment. In some environments with high temperatures and low humidity, the pot-in-pot cooling receptacle may cool the liquid down to 4.5° C.

The cooling receptacle may be used in combination with at least one of the conduit, the heatsink, the heat pump, and the fan. In one example, the liquid may surround a portion of the conduit. In particular, the liquid may completely surround a portion of the conduit. In some embodiments, a combination of at least the cooling receptacle and the heat pump may provide up to about 60° C. of a temperature drop compared to a device without the cooling element. The cooled side of the heat pump may be coupled to, or in contact with, the cooling receptacle. The heatsink may be at least partially disposed in the interior volume of the cooling receptacle in fluid communication with the liquid in the cooling receptacle. The heatsink may be coupled to, or in contact with, the cooled side of the heat pump.

Any type of water block may be used that is configured to cool liquid flowing through the water block. The water block may be used with any suitable liquid, such as water. The water block may be formed of a thermally conductive material having at least one lumen formed therein for liquid to flow through. Heat from the aerosol may heat the liquid and then transferred away from the liquid by the thermally conductive material. The cooling airflow outside of the aerosol conduit may draw heat away from the water block.

The water block may be used in combination with at least one of the conduit, the heatsink, the heat pump, the fan, and the cooling receptacle. In one example, the cooling receptacle may include one or more ports in fluid communication with the at least one lumen of the water block. Liquid contained in the cooling receptacle may be heated by the aerosol, for example, through the conduit. The heated liquid may be cooled in response to flowing through the water block. The liquid may be connected in a circuit to allow the cooled liquid to return to the cooling receptacle. In some embodiments, the cooled side of the heat pump may be coupled to, or in contact with, the water block to further enhance cooling of the heated liquid. A fan may also be positioned to facilitate airflow past the heated side of the heat pump.

The liquid pump may be any suitable type. In one example, the liquid pump may use electrical energy to move, or circulate, liquid. In another example, the liquid pump may use, or be supported by, the suction of the user while puffing. In this case, characteristics of the liquid pump may be used to adjust the RTD. The liquid pump may not provide cooling by itself. When used with other components, the liquid pump may be considered an active device that facilitates cooling. The pump may be used in combination with at least one of the conduit, the heatsink, the heat pump, the fan, the cooling receptacle, and the water block. In one example, the liquid pump may be used to flow liquid through the water block and the reservoir. In particular, the pump may flow heated liquid from the reservoir to the water block for cooling.

In some embodiments, a combination of at least the liquid pump and the cooling receptacle may provide improved cooling over using the cooling receptacle without the liquid pump. The liquid pump may reduce the amount of time the liquid is in contact with the conduit before being cooled. A higher pumping flow may provide more cooling for the same amount of liquid. As a result, the interior volume may be less than the interior volume of a cooling receptacle without the liquid pump. This may allow the shisha device to have a size that is more comparable to the size of a traditional shisha device.

The shisha device may include a chamber having an air-accelerating inlet. The chamber may be between the aerosol-generating element and the vessel in an airflow path of the shisha device. Aerosol travelling from the aerosol-generating element, or from a zone proximal to the aerosol-generating element to the vessel may pass through the chamber. The chamber may include an inlet that accelerates the aerosol as it enters the chamber. The aerosol exiting the inlet may decelerate, which may improve the aerosol nucleation process and cause an increase in visible aerosol relative to devices that do not include a chamber having an air-accelerating inlet. The amount of visible aerosol may be increased in the main chamber of the unit, in the headspace of the vessel, or in both the main chamber and the vessel. In addition, or alternatively, the total aerosol mass delivered by the shisha device may be increased relative to devices that do not include a chamber having an air-accelerating inlet. For example, the total aerosol mass may increase about 1.5-fold or greater or about 2-fold or greater, such as about 3-fold.

The accelerating element may include, or be formed as, the inlet of the chamber. The description herein of the inlet may be applicable to a nozzle that is at least partially formed by the accelerating element. In some embodiments, the nozzle formed by the cooling element and the accelerating element also serves as the inlet.

The airflow path may include the airflow channel. The airflow path may extend at least, for example, from an air inlet channel to the headspace outlet.

The chamber may have a main chamber in fluid communication with the inlet. The main chamber is sized and shaped to allow deceleration of the aerosol in the main chamber when the aerosol exits the inlet and enters the main chamber. The main chamber may have any suitable size and shape that allows deceleration of the aerosol. Preferably, the main chamber is substantially cylindrical, but may be of any other suitable shape.

The main chamber may have any suitable diameter. For purposes of the present disclosure, unless otherwise specified, "diameter" is a maximum transverse distance from a first end of the object to a second end of the object opposite to the first end. By way of example, the "diameter" may be a diameter of an object having a circular transverse section or may be a width of an object having rectangular transverse section. In some examples, the main chamber has a diameter of at least about 10 mm. For example, the diameter of the main chamber may be from about 10 mm to about 50 mm, such as about 30 mm.

The main chamber may have any suitable length. In some examples, the main chamber has a length of at least about 10 mm. For example, the length of the main chamber may be from about 10 mm to about 100 mm, such as about 40 mm.

Preferably, the inlet protrudes into the main chamber. For example, a first end of the inlet may be formed at an exterior surface of a housing of the chamber, and a second end of the inlet may extend into the main chamber.

Any suitable inlet that accelerates the air carrying the aerosol may be used. A suitable inlet may include guides defining a constricted air flow cross section, which will force the air to accelerate substantially in the axial direction. In some examples, the inlet has a first aperture in proximity to the aerosol-generating element and a second aperture in proximity to the main chamber. Aerosol from the aerosol-generating element flows into the inlet through the first aperture and out of the second aperture into the main chamber. The first aperture has a diameter larger than the second aperture.

The first aperture may have any suitable dimensions. For example, the first aperture of the inlet may have a diameter in a range from about 1 mm to about 10 mm, such as from about 2 mm to about 9 mm, or about 7 mm.

The second aperture of the inlet may have any suitable dimensions. For example, the second aperture may have a diameter in a range from about 0.5 mm to about 4 mm, such as from about 0.5 mm to about 2 mm, or about 1 mm.

The inlet may have any suitable length. For example, the length of the inlet from the first aperture to the second aperture may be from about 1 mm to about 30 mm, such as from about 1 mm to about 20 mm or from about 5 mm to about 30 mm, such as about 20 mm.

Preferably, the inlet has a frusto-conical shape. For example, the inlet may be in the form of a nozzle. An inlet having a frusto-conical shape may allow for efficient acceleration of the aerosol as the aerosol is drawn through the inlet.

The chamber may have any suitable number of air-accelerating inlets. For example, the chamber may have one or more air-accelerating inlet. In some example, the chamber may have 2, 3, 4, 5, or more air-accelerating inlets.

The chamber may include one or more parts. For example, the main chamber and the one or more inlets may be formed from the same part or from different parts. Preferably, the main chamber is formed from material that allows a user to observe aerosol within the chamber. For example, the main chamber may be formed from optically transparent or opaque material.

The chamber may be positioned in an airflow path between the aerosol-generating element and the vessel configured to contain the liquid. A conduit may connect the chamber to an outlet of the aerosol-generating element. Alternatively, the inlet of the chamber may be the outlet of the aerosol-generating element.

The shisha device may include a main conduit that extends from the chamber into the vessel. Preferably, the main conduit extends into the vessel below a liquid fill level of the vessel. In some examples, the main chamber of the chamber is fluidly connected to the main conduit. In other examples, the main conduit extending into the vessel forms the main chamber of the chamber.

A shisha device of the present invention may have any suitable aerosol-generating element for heating an aerosol-forming substrate to produce an aerosol. Preferably, the aerosol-forming substrate is heated by an electric heating element. The aerosol-generating element contains a receptacle for containing the aerosol-forming substrate to be heated by the heating element. Preferably, the aerosol-forming substrate is in a cartridge when heated by the heating element, and, thus, the aerosol-generating element comprises a cartridge receptacle configured to receive the cartridge. Alternatively, aerosol-forming substrate that is not in a cartridge may be placed in the receptacle.

The aerosol-generating element comprises an air inlet and an aerosol outlet. When a user draws on the shisha device, ambient air may enter the air inlet, pass over or through the aerosol-forming substrate, and exit the aerosol outlet for entry into the inlet of the chamber. In some examples, the aerosol outlet of the aerosol-generating element is, or forms at least a part of, the inlet of the chamber.

Preferably, the heating element of the aerosol-generating element defines at least one surface of the receptacle for holding the aerosol-forming substrate or cartridge. More preferably, the heating element defines at least two surfaces of the receptacle. For example, the heating element may form at least a portion of two or more of a top surface, a side surface, and a bottom surface. Preferably, the heating element defines at least a portion of the top surface and at least a portion of a side surface. More preferably, the heating element forms the entire top surface and an entire side wall surface of the receptacle. The heating element may be disposed on an inner surface or an outer surface of the receptacle.

Any suitable heating element may be employed. For example, the heating element may include one or both of electrically resistive and inductive heating components. Preferably, the heating element has an electrically resistive heating component. For example, the heating element may have one or more electrically resistive wires or other resistive elements. The resistive wires may be in contact with a thermally conductive material to distribute heat produced over a broader area. Examples of suitable thermally conductive materials include aluminium, copper, zinc, nickel, silver, and combinations thereof. For purposes of this disclosure, if electrically resistive wires are in contact with a thermally conductive material, both the electrically resistive wires and the thermally conductive material are part of the heating element that forms at least a portion of the surface of the cartridge receptacle.

In some examples, a heating element comprises an inductive heating element. For example, the heating element may have a susceptor material that forms a surface of the cartridge receptacle.

As used herein, the term "susceptor" refers to a material that is capable to convert electromagnetic energy into heat. When located in an alternating electromagnetic field, typically eddy currents are induced and hysteresis losses may occur in the susceptor causing heating of the susceptor. As the susceptor is located in thermal contact or close thermal proximity with the aerosol-forming substrate, the substrate is heated by the susceptor such that an aerosol is formed. Preferably, the susceptor is arranged at least partially in direct physical contact with the aerosol-forming substrate.

The susceptor may be formed from any material that can be inductively heated to a temperature sufficient to generate an aerosol from the aerosol-forming substrate. Preferably, the susceptor comprises a metal or carbon. A suitable susceptor may include a ferromagnetic material, for example ferritic iron, a ferromagnetic alloy, such as ferromagnetic steel or stainless steel, and ferrite. A suitable susceptor may be, or include, aluminium.

Suitable susceptors include metal susceptors, for example stainless steel. However, susceptor materials may also include or be made of graphite, molybdenum, silicon carbide, aluminium, niobium, Inconel alloys (austenite nickel-chromium-based superalloys), metallized films, ceramics such as for example zirconia, transition metals such as for example Fe, Co, Ni, or metalloids components such as for example B, C, Si, P, Al.

A susceptor preferably include more than 5%, preferably more than 20%, preferably more than 50% or 90% of ferromagnetic or paramagnetic materials. Suitable susceptors may be heated to a temperature in excess of 250 degrees Celsius. Suitable susceptors may have a non-metallic core with a metal layer disposed on the non-metallic core, for example metallic tracks formed on a surface of a ceramic core.

In the system according to the invention, at least one surface of the receptacle or of a cartridge containing aerosol-forming substrate for placement in the receptacle may include susceptor material. Preferably, at least two surfaces of the receptacle have susceptor material. For example, the base and at least one side wall of the receptacle may include susceptor material. Advantageously, at least portions of an outer surface of the cartridge receptacle are made of susceptor material. However, also at least portions of an inner side of the cartridge receptacle may be coated or lined with susceptor material. Preferably, a lining is attached or fixed to the shell such as to form an integral part of the shell.

In addition, or alternatively, the cartridge may have a susceptor material.

The shisha device may also include one or more induction coils configured to induce eddy currents and/or hysteresis losses in a susceptor material, which results in heating of the susceptor material. A susceptor material may also be positioned in the cartridge containing the aerosol-forming substrate. A susceptor element comprising the susceptor material may have any suitable material, such as those described in, for example, PCT Published Patent Applications WO 2014/102092 and WO 2015/177255.

The shisha device may include control electronics operably coupled to the resistive heating element or induction coil. The control electronics are configured to control heating of the heating element.

The control electronics may be provided in any suitable form and may, for example, include a controller or a memory and a controller. Control electronics may include memory that contains instructions that cause one or more components to carry out a function or aspect of the control electronics. Functions attributable to control electronics in this disclosure may be embodied as one or more of software, firmware, and hardware.

In particular, one or more of the components, such as controllers, described herein may include a processor, such as a central processing unit (CPU), computer, logic array, or other device capable of directing data coming into or out of the control electronics. The controller may include one or more computing devices having memory, processing, and communication hardware. The controller may include circuitry used to couple various components of the controller together or with other components operably coupled to the controller. The functions of the controller may be performed by hardware and/or as computer instructions on a non-transient computer readable storage medium.

The processor of the controller may include any one or more of a microprocessor, a microcontroller, a digital signal processor (DSP), an application specific integrated circuit (ASIC), a field-programmable gate array (FPGA), and/or equivalent discrete or integrated logic circuitry. In some examples, the processor may include multiple components, such as any combination of one or more microprocessors, one or more controllers, one or more DSPs, one or more ASICs, and/or one or more FPGAs, as well as other discrete or integrated logic circuitry. The functions attributed to the controller or processor herein may be embodied as software, firmware, hardware, or any combination thereof. While described herein as a processor-based system, an alternative controller could utilize other components such as relays and timers to achieve the desired results, either alone or in combination with a microprocessor-based system.

In one or more embodiments, the exemplary systems, methods, and interfaces may be implemented using one or more computer programs using a computing apparatus, which may include one or more processors and/or memory. Program code and/or logic described herein may be applied to input data/information to perform functionality described herein and generate desired output data/information. The output data/information may be applied as an input to one or more other devices and/or methods as described herein or as would be applied in a known fashion. In view of the above, it will be readily apparent that the controller functionality as described herein may be implemented in any manner known to one skilled in the art.

In some embodiments, the control electronics may include a microprocessor, which may be a programmable microprocessor. The electronic circuitry may be configured to regulate a supply of power. The power may be supplied to the heater element or induction coil in the form of pulses of electrical current.

If the heating element is a resistive heating element, the control electronics may be configured to monitor the electrical resistance of the heating element and to control the supply of power to the heating element depending on the electrical resistance of the heating element. In this manner, the control electronics may regulate the temperature of the resistive element.

If the heating components include an induction coil and the heating element comprises a susceptor material, the control electronics may be configured to monitor aspect of the induction coil and to control the supply of power to the induction coil depending on the aspects of the coil such as described in, for example, WO 2015/177255. In this manner, the control electronics may regulate the temperature of the susceptor material.

The shisha device may have a temperature sensor, such as a thermocouple. The temperature sensor may be operably coupled to the control electronics to control the temperature of the heating elements. The temperature sensor may be positioned in any suitable location. For example, the temperature sensor may be configured to insert into the aerosol-forming substrate or a cartridge received within the receptacle to monitor the temperature of the aerosol-forming substrate being heated. In addition, or alternatively, the temperature sensor may be in contact with the heating element. In addition, or alternatively, the temperature sensor may be positioned to detect temperature at an aerosol outlet of the shisha device, such as the aerosol outlet of the aerosol-generating element. In addition, or alternatively, the temperature sensor may be in contact with the cooling element, such as the heated side of the heat pump. The sensor may transmit signals regarding the sensed temperature to the control electronics, which may adjust heating of the heating elements to achieve a suitable temperature at the sensor.

Any suitable thermocouple may be used, such as a K-type thermocouple. The thermocouple may be placed in the cartridge where the temperature is lowest. For example, the thermocouple may be placed in the centre, or middle, of the cartridge. In some shisha devices, the thermocouple may be placed underneath the aerosol-forming substrate (such as molasses), for example, by placing the thermocouple between the substrate receptacle and the heating element (such as charcoal) and then placing substrate on top.

Regardless of whether the shisha device comprises a temperature sensor, the device is preferably configured to heat an aerosol-forming substrate received in the receptacle to an extent sufficient to generate an aerosol without combusting the aerosol-forming substrate.

The control electronics may be operably coupled to a power supply. The shisha device may include any suitable power supply. For example, a power supply of a shisha device may be a battery or set of batteries (such as a battery pack). In some examples, one or more than one component of the battery, such as the cathode and anode elements, or even the entire battery can be adapted to match geometries of a portion of a shisha device in which they are disposed. In some cases, the battery or battery component may be adapted by rolling or assembling to match geometries. The batteries of power supply unit can be rechargeable, as well as it may be removable and replaceable. Any suitable battery may be used. For example, heavy duty type or standard batteries existing in the market, such as used for industrial heavy duty electrical power-tools. Alternatively, the power supply unit can be any type of electric power supply comprising a super or hyper-capacitor. Alternatively, the device can be powered connected to an external electrical power source, and electrically and electronically designed for such purpose. Regardless of the type of power supply employed, the power supply preferably provides sufficient energy for the normal functioning of the device for approximately 70 minutes of continuous operation of the device, before being recharged or needing to connect to an external electrical power source.

The shisha device comprises an air inlet channel in fluid communication with the receptacle for containing the aerosol-forming substrate. Ambient air flows through the air inlet channel to the receptacle and the substrate disposed in the receptacle to carry aerosol generated from the aerosol-forming substrate to the aerosol outlet when the shisha device is in use. Preferably, at least a portion of the air inlet channel is formed by a heating element to preheat the air prior to entering the receptacle. Preferably, a portion of the heating element that forms a surface of the receptacle forms a portion of the air inlet channel. Preferably the air inlet channel is formed from one or both of the top surface of the receptacle and a side wall of the receptacle that is formed by the heating element. Preferably, the air inlet channel is formed by both the top surface of the receptacle and a side wall of the receptacle that is formed by the heating element.

Preferably, the heating element may include, or be formed of, a part of the cooling element configured to preheat air.

Any suitable portion of the air inlet channel may be formed by the heating element. Preferably, about 50% or more of the length of the air inlet channel is formed by the heating element. In many examples, the heating element will form 95% or less of the length of the air inlet channel.

Air flowing through the air inlet channel may be heated by any suitable amount by the heating element. In some examples, the air will be sufficiently heated to cause an aerosol to form when the heated air flows through the aerosol-forming substrate or a cartridge containing aerosol-forming substrate. In some examples, the air is not sufficiently heated to cause aerosol formation on its own but facilitates heating of the substrate by the heating element. Preferably, the amount of energy supplied to the heating element to heat the substrate and cause aerosol formation is reduced by 5% or more, such as 10% or more, or 15% or more, when the air is preheated in accordance with the present invention, relative to designs in which air is not preheated. Typically, the energy savings will be less than 75%.

The substrate is preferably heated, through a combination of the preheated air and heating from the heating elements, to a temperature in a range from about 150° C. to about 250° C.; more preferably from about 180° C. to about 230° C. or from about 200° C. to about 230° C.

Preferably, at least a portion of the airflow path is formed between the heating element and a heat shield. Preferably, substantially the entire portion of the air inlet channel that is formed by the air inlet channel is also formed by the heat shield. The heat shield and the heating element may form opposing surfaces of the air inlet channel, such that the air flows between the heat shield and the heating element. Preferably, the heat shield is positioned exterior to an interior formed by the receptacle.

Any suitable heat shield material may be employed. Preferably, the heat shield material has a surface that is thermally reflective. The thermally reflective surface may be backed with an insulating material. In some examples, the thermally reflective material comprises an aluminium metalized film or other suitable thermally reflective material. In some examples, the insulating material comprises a ceramic material. In some examples, the heat shield comprises an aluminium metalized film and a ceramic material backing.

The air inlet channel may comprise one or more apertures through the receptacle such that ambient air from outside the shisha device may flow through the air inlet channel and into the receptacle through the apertures. If the air inlet channel comprises more than one aperture, the air inlet channel may include a manifold to direct air flowing through the air inlet channel to each aperture. Preferably, the shisha device comprises two or more air inlet channels.

The receptacle may include any suitable number of apertures in communication with one or more air inlet channels. For example, the receptacle may include 1 to 1000 apertures, such as 10 to 500 apertures. The apertures may be of uniform size or non-uniform size. The apertures may be of uniform or non-uniform shape. The apertures may be uniformly distributed or non-uniformly distributed. The apertures may be formed in the cartridge receptacle at any suitable location. For example, the apertures may be formed in one or both of a top or a sidewall of the receptacle. Preferably, the apertures are formed in the top of the receptacle.

The receptacle is preferably shaped and sized to allow contact between one or more wall or ceiling of the receptacle and the aerosol-forming substrate or a cartridge containing the aerosol-forming substrate when the substrate or cartridge is received by the receptacle to facilitate conductive heating of the aerosol-forming substrate by the heating element forming a surface of the receptacle. In some examples, an air gap may be formed between at least a portion of a cartridge containing the aerosol-forming substrate and a surface of the receptacle, where the air gaps serve as a portion of the air inlet channel.

Preferably, the interior of the receptacle and the exterior of the cartridge containing the aerosol-forming substrate are of similar size and dimensions. Preferably, the interior of the receptacle and the exterior of the cartridge has a height to a base width (or diameter) ratio of greater than about 1.5 to 1. Such ratios may allow for more efficient depletion of the aerosol-forming substrate within the cartridge during use by allowing heat from the heating elements to penetrate to the middle of the cartridge. For example, the receptacle and cartridge may have a base diameter (or width) about 1.5 to about 5 times the height, or about 1.5 to about 4 times the height, or about 1.5 to about 3 times the height. Similarly, the receptacle and cartridge may have a height about 1.5 to about 5 times the base diameter (or width), or about 1.5 to about 4 times the base diameter (or width), or about 1.5 to about 3 times the base diameter (or width). Preferably, the receptacle and cartridge have a height to base diameter ratio or base diameter to height ratio of from about 1.5 to 1 to about 2.5 to 1.

In some examples, the interior of the receptacle and the exterior of the cartridge has a height in a range from about 15 mm to about 25 mm and a base diameter in a range from about 40 mm to about 60 mm.

The receptacle may be formed from one or more parts. Preferably, the receptacle is formed by two or more parts. Preferably, at least one part of the receptacle is movable relative to another part to allow access to the interior of the receptacle for inserting the cartridge into the receptacle. For example, one part may be removably attachable to another part to allow insertion of the aerosol-forming substrate or the cartridge containing the aerosol-forming substrate when the parts are separated. The parts may be attachable in any suitable manner, such as through threaded engagement, interference fit, snap fit, or the like. In some examples, the parts are attached to one another via a hinge. When the parts are attached via a hinge, the parts may also include a locking mechanism to secure the parts relative to one another when the receptacle is in a closed position. In some examples, the receptacle comprises a drawer that may be slid open to allow the aerosol-forming substrate or cartridge to be placed into the drawer and may be slid closed to allow the shisha device to be used.

Any suitable aerosol-forming cartridge may be used with a shisha device as described herein. Preferably, the cartridge comprises a thermally conductive housing. For example, the housing may be formed from aluminium, copper, zinc, nickel, silver, and combinations thereof. Preferably, the housing is formed from aluminium. In some examples, the cartridge is formed from one or more material less thermally conductive than aluminium. For example, the housing may be formed from any suitable thermally stable polymeric material. If the material is sufficiently thin sufficient heat may be transferred through the housing despite the housing being formed from material that is not particularly thermally conductive.

The cartridge may include one or more apertures formed in the top and bottom of the housing to allow air flow through the cartridge when in use. If the top of the receptacle comprises one or more apertures, at least some of the apertures in the top of the cartridge may aligned with the apertures in the top of the receptacle. The cartridge may include an alignment feature configured to mate with a complementary alignment feature of the receptacle to align the apertures of the cartridge with the apertures of the receptacle when the cartridge is inserted into the receptacle. The apertures in the housing of the cartridge may be covered during storage to prevent aerosol-forming substrate stored in the cartridge from spilling out of the cartridge. In addition, or alternatively, the apertures in the housing may have dimensions sufficiently small to prevent or inhibit the aerosol-forming substrate from exiting the cartridge. If the apertures are covered, a consumer may remove the cover prior to inserting the cartridge into the receptacle. In some examples, the receptacle is configured to puncture the cartridge to form apertures in the cartridge. Preferably, the receptacle is configured to puncture the top of the cartridge.

The cartridge may be of any suitable shape. Preferably, the cartridge has a frusto-conical or cylindrical shape.

Any suitable aerosol-forming substrate may be placed in a cartridge for use with shisha devices of the invention or may be placed in the receptacle of the aerosol-generating unit. The aerosol-forming substrate is preferably a substrate capable of releasing volatile compounds that may form an aerosol. The volatile compounds may be released by heating the aerosol-forming substrate. The aerosol-forming substrate may be solid or liquid or include both solid and liquid components. Preferably, the aerosol-forming substrate is solid.

The aerosol-forming substrate may include nicotine. The nicotine containing aerosol-forming substrate may include a nicotine salt matrix. The aerosol-forming substrate may include plant-based material. The aerosol-forming substrate may include tobacco, and preferably the tobacco containing material contains volatile tobacco flavour compounds, which are released from the aerosol-forming substrate upon heating.

The aerosol-forming substrate may include homogenized tobacco material. Homogenized tobacco material may be formed by agglomerating particulate tobacco. Where present, the homogenized tobacco material may have an aerosol-former content of equal to or greater than 5% on a dry weight basis, and preferably between greater than 30% by weight on a dry weight basis. The aerosol-former content may be less than about 95% on a dry weight basis.

The aerosol-forming substrate may alternatively or additionally include a non-tobacco-containing material. The aerosol-forming substrate may include homogenized plant-based material.

The aerosol-forming substrate may include, for example, one or more of: powder, granules, pellets, shreds, spaghettis, strips or sheets containing one or more of: herb leaf, tobacco leaf, fragments of tobacco ribs, reconstituted tobacco, homogenized tobacco, extruded tobacco and expanded tobacco.

The aerosol-forming substrate may include at least one aerosol-former. The aerosol-former may be any suitable known compound or mixture of compounds that, in use, facilitates formation of a dense and stable aerosol and that is substantially resistant to thermal degradation at the operating temperature of the aerosol-generating element. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Particularly preferred aerosol formers are polyhydric alcohols or mixtures thereof, such as triethylene glycol, 1,3-butanediol and, most preferred, glycerine. The aerosol-forming substrate may include other additives and ingredients, such as flavourants. The aerosol-forming substrate preferably comprises nicotine and at least one aerosol-former. In a particularly preferred embodiment, the aerosol-former is glycerine.

The solid aerosol-forming substrate may be provided on or embedded in a thermally stable carrier. The carrier may include a thin layer on which the solid substrate deposited on a first major surface, on second major outer surface, or on both the first and second major surfaces. The carrier may be formed of, for example, a paper, or paper like material, a non-woven carbon fiber mat, a low mass open mesh metallic screen, or a perforated metallic foil or any other thermally stable polymer matrix. Alternatively, the carrier may take the form of powder, granules, pellets, shreds, spaghettis, strips or sheets. The carrier may be a non-woven fabric or fiber bundle into which tobacco components have been incorporated. The non-woven fabric or fiber bundle may include, for example, carbon fibers, natural cellulose fibers, or cellulose derivative fibers.

In some examples, the aerosol-forming substrate is in the form of a suspension. For example, the aerosol-forming substrate may be in the form of a thick, molasses-like, suspension.

Air that enters the cartridge flows across the aerosol-forming substrate, entrains aerosol, and exits the cartridge and receptacle via an aerosol outlet. From the aerosol outlet, the air carrying the aerosol enters a vessel.

The shisha device may include any suitable vessel defining an interior volume configured to contain a liquid and defining an outlet in head-space above a liquid fill level. The vessel may include an optically transparent or opaque housing to allow a consumer to observe contents contained in the vessel. The vessel may include a liquid fill demarcation, such as a liquid fill line. The vessel housing may be formed of any suitable material. For example, the vessel housing may include glass or suitable rigid plastic material. Preferably, the vessel is removable from a portion of the shisha device having the aerosol-generation element to allow a consumer to fill or clean the vessel.

The vessel may be filled to a liquid fill level by a consumer. The liquid preferably comprises water, which may optionally be infused with one or more colorants, flavourants, or colorant and flavourants. For example, the water may be infused with one or both of botanical or herbal infusions.

Aerosol entrained in air exiting the chamber may travel through the main conduit positioned in the vessel. The main conduit may have an opening below the liquid fill level of the vessel, such that aerosol flowing through the vessel flows through the opening of the main conduit, then through the liquid, into headspace of the vessel and exits the headspace outlet for delivery to a consumer.

The headspace outlet may be coupled to a hose comprising a mouthpiece for delivering the aerosol to a consumer. The mouthpiece may include a switch activatable by a user or a puff sensor operably coupled to the control electronics of the shisha device. Preferably, the switch or puff sensor is wirelessly coupled to the control electronics. Activation of a switch or puff sensor may cause the control electronics to activate the heating element, rather than constantly supplying energy to the heating element. Accordingly, the use of a switch or puff sensor may serve to save energy relative to devices not employing such elements to provide on-demand heating rather than constant heating.

For purposes of example, one method for using a shisha device as described herein is provided below in chronological order. The vessel may be detached from other components of the shisha device and filled with water. One or more of natural fruit juices, botanicals, and herbal infusions may be added to the water for flavouring. The amount of liquid added should cover a portion of the main conduit but should not exceed a fill level mark that may optionally exist on the vessel. The vessel is then reassembled to the shisha device. A portion of the aerosol-generating element may be removed or opened to allow the aerosol-forming substrate or the cartridge to be inserted into the receptacle. The aerosol-generating element is then reassembled or closed. The device may then be turned on. A user may puff from a mouth piece until a desired volume of aerosol is produced to fill the chamber having the air-accelerating inlet. The user may puff on the mouth piece as desired. The user may continue using the device until no more aerosol is visible in the chamber. Preferably, the device will automatically shut off when the cartridge or substrate is depleted of usable aerosol-forming substrate. Alternatively, or in addition, the consumer may refill the device with fresh aerosol-forming substrate or a fresh cartridge after, for example, receiving the cue from the device that the consumables are depleted or nearly depleted. If refilled with fresh substrate or a fresh cartridge, the device may continue to be used. Preferably, the shisha device may be turned off at any time by a consumer by, for example, switching off the device.

In some examples, a user may activate one or more heating elements by using an activation element on, for example, the mouthpiece. The activation element may be, for example, in wireless communication with the control electronics and may signal control electronics to activate the heating element from standby mode to full heating. Preferably, such manual activation is only enabled while the user puffs on the mouthpiece to prevent overheating or unnecessary heating of aerosol-forming substrate in the cartridge.

In some examples, the mouthpiece comprises a puff sensor in wireless communication with the control electronics and puffing on the mouthpiece by a consumer causes activation of the heating elements from a standby mode to full heating.

A shisha device of the invention may have any suitable air management. In one example, puffing action from the user will create a suction effect causing a low pressure inside the device which will cause external air to flow through air inlet of the device, into the air inlet channel, and into the receptacle of the aerosol-generating element. The air may then flow through aerosol-forming substrate or a cartridge containing the substrate in the receptacle to carry aerosol through the aerosol outlet of the receptacle. The aerosol then may flow into a first aperture of the air-accelerating inlet of the chamber (unless the outlet of the aerosol-generating element also serves as the air-accelerating inlet of the chamber). As the air flows through the inlet of the chamber the air is accelerated. The accelerated air exits the inlet through a second aperture to enter the main chamber of the chamber, where the air is decelerated. Deceleration in the main chamber may improve nucleation leading to enhanced visible aerosol in the chamber. The aerosolized air then may exit the chamber and flow through the main conduit (unless the main conduit is the main chamber of the chamber) to the liquid inside the vessel. The aerosol will then bubble out of the liquid and into head space in the vessel above the level of the liquid, out the headspace outlet, and through the hose and mouthpiece for delivery to the consumer. The flow of external air and the flow of the aerosol inside the shisha device may be driven by the action of puffing from the user.

Preferably, assembly of all main parts of a shisha device of the invention assures hermetic functioning of the device. Hermetic function should assure that proper air flow management occurs. Hermetic functioning may be achieved in any suitable manner. For example, seals such as sealing rings and washers maybe used to ensure hermetic sealing.

Sealing rings and sealing washers or other sealing elements may be made of any suitable material or materials. For example, the seals may include one or more of graphene compounds and silicon compounds. Preferably, the materials are approved for use in humans by the U.S. Food and Drug Administration.

Main parts, such as the chamber, the main conduit from the chamber, a cover housing of the receptacle, and the vessel may be made of any suitable material or materials. For example, these parts may independently be made of glass, glass-based compounds, polysulfone (PSU), polyethersulfone (PES), or polyphenylsulfone (PPSU). Preferably, the parts are formed of materials suitable for use in standard dish washing machines.

In some examples, a mouthpiece of the invention incorporates a quick coupling male/female feature to connect to a hose unit.

Overall, the electronic shisha device may operate as follows. A cartridge filled with an aerosol-forming substrate may be electrically heated. An inner surface of the heating element in contact with the cartridge may be used to heat the aerosol-generating substance. The heating element may be configured such that the temperature provided is sufficient to generate an aerosol without combusting, or burning, the aerosol-forming substrate. A user may draw air from the electric shisha, air may enter via an air inlet channel, pass the cooling element, go along a cartridge, then toward a bottom of the cartridge, then to a bottom of the receptacle. The generated aerosol may be accelerated while passing through an accelerating element. Before or during acceleration, the generated aerosol may be cooled by the cooling element to increase condensation in the aerosol. The aerosol may experience a pressure change upon entering a chamber and expand inside the chamber, which may decelerate the aerosol, before passing through a main conduit, or stem pipe, that is partly immersed in water in a lower volume of a vessel. The generated aerosol passes through the water and expands in an upper volume of the vessel before being extracted by a hose.

While the disclosure is not so limited, an appreciation of various aspects of the disclosure will be gained through a discussion of the illustrative embodiments, drawings, and specific examples provided below, which provide shisha devices with enhanced aerosol characteristics using a cooling element in the airflow path of the shisha device. Various modifications, as well as additional embodiments of the disclosure, will become apparent herein to one skilled in the art.

When referring to the drawings, it will be understood that other aspects not depicted in the drawings fall within the scope and spirit of this disclosure. Like numbers used in the figures refer to like components, steps and the like. However, it will be understood that the use of a number to refer to a component in each figure is not intended to limit the component in another figure labelled with the same number. In addition, the use of different numbers to refer to components in different figures is not intended to indicate that the different numbered components cannot be the same or similar to other numbered components. The figures are presented for purposes of illustration and not limitation. Schematic drawings presented in the figures are not necessarily to scale.

In one illustrative embodiment, the shisha device comprises a cooling element formed of a thermally conductive material (aluminium) in addition to one or more other components that form the airflow path between at least one air inlet channel and the headspace outlet. In particular, at least a conduit of the cooling element is formed of the thermally conductive material. The cooling element may include a heatsink (plurality of fins) coupled to the conduit. The heatsink may surround the conduit. The cooling element may also include a heat pump (Peltier element) may be coupled to the heatsink and may be operably coupled to an electrical power source. The shisha device may provide proper cooling airflow to one or more of the components of the cooling element with a ventilation design. The cooling element may include a fan to facilitate the cooling airflow. The air from the cooling airflow may be heated by the cooling element. This preheated air may be directed by the ventilation design of the shisha device toward the aerosol-generating element to facilitate the generating of aerosol.

In one or more embodiments, the overall size of the cooling element may be small enough to fit within a shisha device. In some embodiments, the cooling element may have a height of about 100 mm, which may include an accelerating element. The heat pumps may be disposed along the side of the conduit. The heated or cooled surface of the heat pump may extend in the same direction as the direction of the airflow channel or aerosol conduit. Each surface may have a surface area of about 30 mm by about 30 mm.

In another illustrative embodiment, the shisha device comprises a cooling element formed of a cooling receptacle. In particular, the cooling receptacle may surround a conduit of the cooling element. The conduit may be formed of thermally conductive material. The cooling receptacle may be formed of a porous material, which may utilize a pot-in-pot design. The shisha device may provide proper cooling airflow to the cooling receptacle, particularly the exterior of the cooling receptacle, with a ventilation design. The cooling element may include a fan to facilitate the cooling airflow. The air from the cooling airflow may be heated by the cooling element. This preheated air may be directed by the ventilation design of the shisha device toward the aerosol-generating element to facilitate the generating of aerosol.

In yet another illustrative embodiment, the shisha device comprises a cooling element formed of a cooling receptacle, a heatsink, and a heat pump. In particular, the cooling receptacle may surround a conduit of the cooling element. The conduit may be formed of a thermally conductive material. The heatsink is at least partially in the interior volume of the cooling receptacle. The heatsink may be coupled to the cooling receptacle. Preferably, the heatsink is in contact with liquid inside the receptacle. The heat pump is coupled to, or in contact with, the receptacle or the heatsink. In particular, the cooled side of the heat pump may be in contact with the receptacle or heatsink. The shisha device may provide proper cooling airflow to the cooling receptacle, particularly the heated side of the heat pump, with a ventilation design. The cooling element may include a fan to facilitate the cooling airflow. The air from the cooling airflow may be heated by the cooling element. This preheated air may be directed by the ventilation design of the shisha device toward the aerosol-generating element to facilitate the generating of aerosol.

In still another illustrative embodiment, the shisha device comprises a cooling element formed of a cooling receptacle, a water block, a liquid pump, and a heat pump. In particular, the cooling receptacle may surround a conduit of the cooling element. The conduit may be formed of a thermally conductive material. The water block may be in fluid communication with liquid inside the cooling receptacle. The liquid pump may be in fluid communication with the liquid of both the water block and the cooling receptacle to circulate water from the cooling receptacle to the water block to be cooled and back to the cooling receptacle to cool the conduit. The heat pump may be coupled to, or in contact with, the water block. In particular, the cooled side of the heat pump may be in contact with the water block. The shisha device may provide proper cooling airflow to the cooling receptacle, particularly the heated side of the heat pump, with a ventilation design. The cooling element may include a fan to facilitate the cooling airflow. The air from the cooling airflow may be heated by the cooling element. This preheated air may be directed by the ventilation design of the shisha device toward the aerosol-generating element to facilitate the generating of aerosol.

Figure 1:
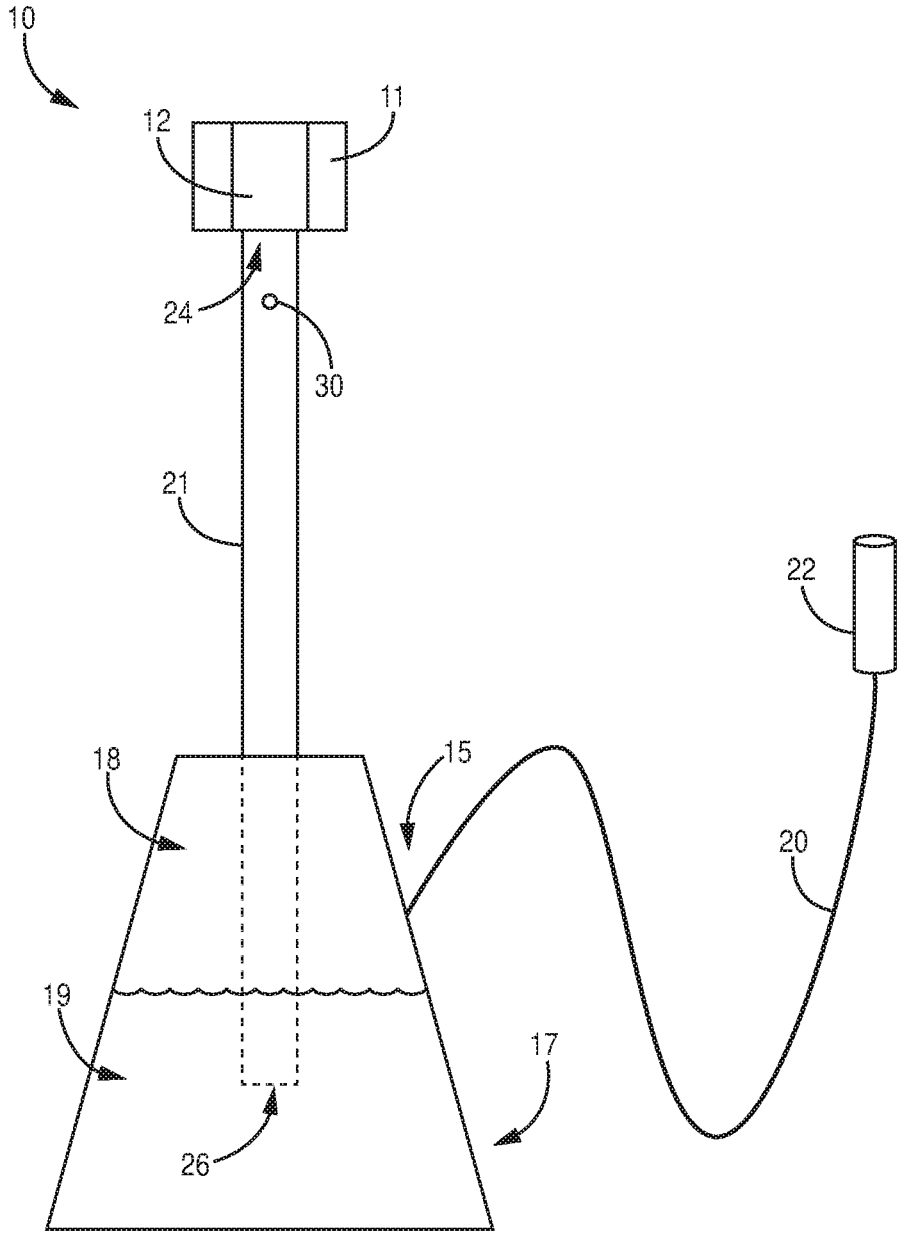
FIG. 1 is a schematic illustration of a shisha device according to an embodiment of the invention.

FIG. 1 shows a shisha device 10 according to an embodiment of the invention. The shisha device 10 comprises an aerosol-generating element 11 configured to receive an aerosol-forming substrate 12. The aerosol-generating element 11 may heat the aerosol-forming substrate 12, for example, by means of an electrical heater (not shown), to generate an aerosol. In use, the generated aerosol flows through an aerosol conduit 21, which includes a ventilation opening 30 in a stem pipe. The aerosol conduit 21 comprises a proximal end portion defining a proximal opening 24 positioned to receive airflow from the aerosol-generating element 11 and a distal end portion defining a distal opening 26 positioned in an interior of a vessel 17. The ventilation opening 30 is positioned between the proximal and distal end portions of aerosol conduit 21.

The aerosol conduit 21 is in fluid communication with the vessel 17. An airflow channel is defined between the aerosol-generating element 11 and the interior of the vessel 17. In particular, the aerosol-generating element 11 is in fluid communication with a vessel 17, by means of aerosol conduit 21 at least partially defining the airflow channel. The interior of the vessel 17 comprises an upper volume 18 for head space and a lower volume 19 for liquid. A hose 20 is in fluid communication with the upper volume 18 through a head space outlet 15 formed in a side of the vessel 17 above a liquid line. A mouthpiece 22 is coupled to hose 20 for a user of the device 10.

Generated aerosol may flow through the aerosol-generating element 11, through the air flow channel via the aerosol conduit 21 into the lower volume 19. The aerosol may pass through liquid in the lower volume 19 and rise into the upper volume 18. Puffing by a user on a mouthpiece of the hose 20 may draw the aerosol in the upper volume 18 through the head space outlet 15, into the hose 20 for inhalation. In particular, negative pressure at the mouthpiece 22 may translate into negative pressure at head space outlet 15 causing airflow through the aerosol-generating element 11 and aerosol conduit 21. Further, the negative pressure causes airflow through the aerosol conduit 21 from the ventilation opening 30 to the distal opening of the aerosol conduit.

The ventilation opening 30 provides ventilation air to aerosol-entrained air from the aerosol-generating element 11. Ventilation air may come from the ambient environment. The ventilation air cools the aerosol-entrained air to facilitate enhanced aerosol production. As illustrated, ventilation opening 30 may be an ambient air aperture positioned adjacent to an ambient air environment.

Figure 2:
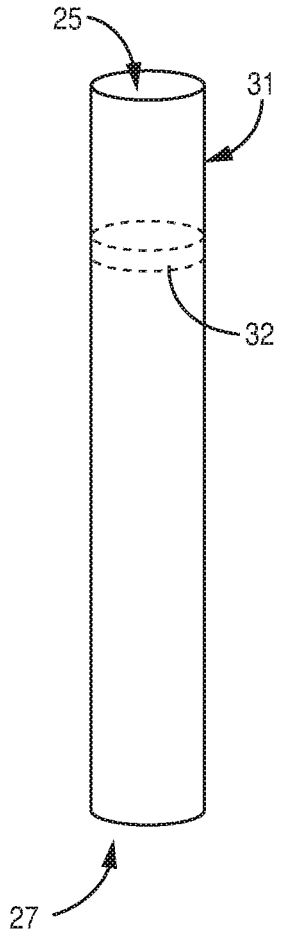
FIG. 2 is a schematic illustration of an alternative aerosol conduit for use with the shisha device of FIG. 1.

FIG. 2 shows alternative aerosol conduit 31 for use with the shisha device 10 extending from a proximal end portion defining a proximal opening 25 and a distal end portion defining a distal opening 27. The aerosol conduit 31 includes ventilation opening 32, which includes a ventilation aperture forming a ring-shaped opening. The ring-shaped opening may provide a more homogenous mixture of ventilation air with aerosol-entrained air. The ring-shaped opening may comprise a plurality of smaller openings, such as slits, as shown in FIG. 2. Each of the slits may have any geometrical shape, such as, for example, rectangular, square, circular or ovular. The ventilation opening 32 may comprise more than one ring shaped openings, such as two ring shaped openings as shown in FIG. 2.

Figure 3:
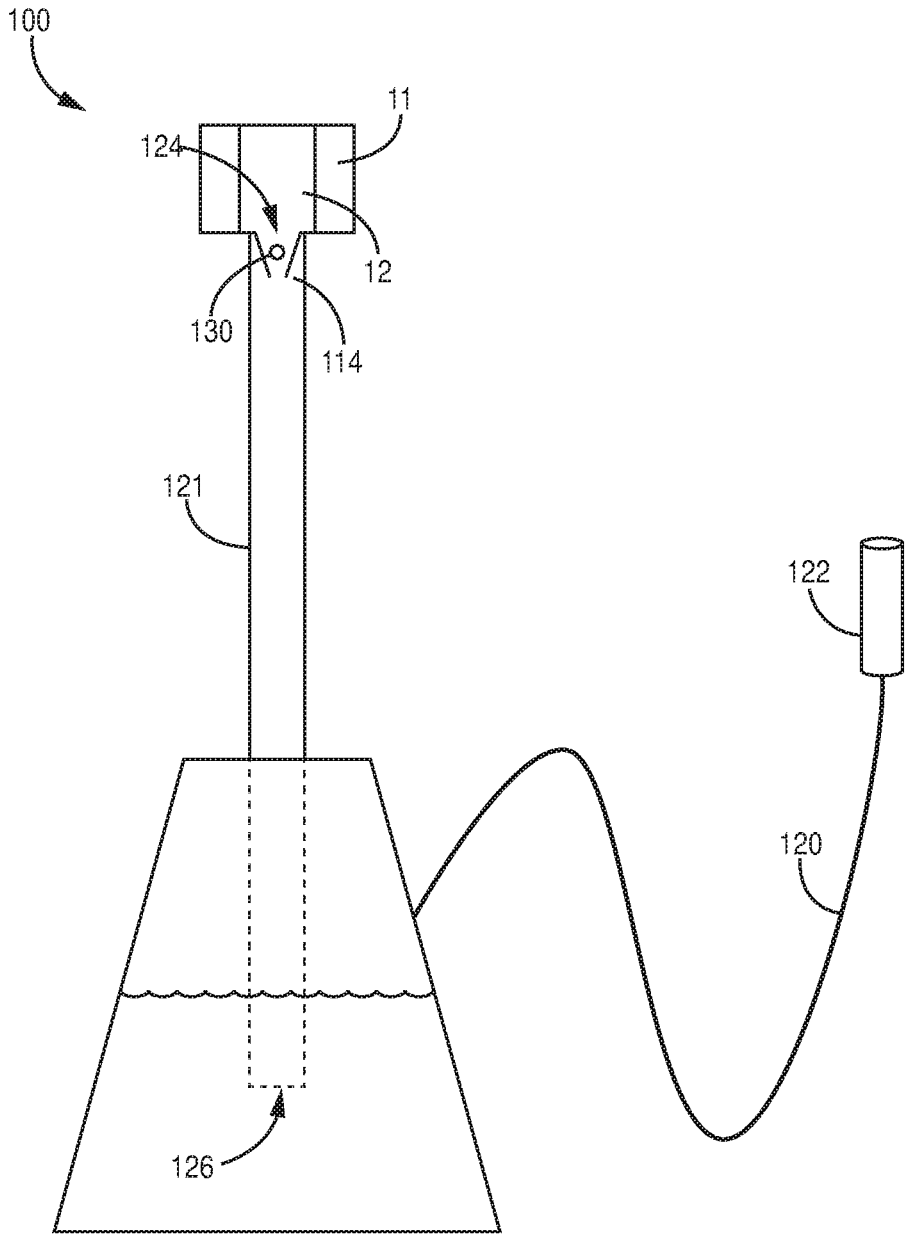
FIG. 3 is a schematic illustration of a shisha device according to another embodiment of the invention.

FIG. 3 shows a shisha device 100 according to another embodiment of the invention. The shisha device 100 is similar to the shisha device 10 of FIG. 1 and includes an aerosol-generating element 11 and aerosol-forming substrate 12, among other elements shown but not discussed again here. The shisha device 100 differs from the shisha device 10 in that the aerosol conduit 121 includes an accelerating element 114. The aerosol conduit 121 extends from a proximal end portion defining a proximal opening 124 to a distal end portion defining a distal opening 126. The stem pipe portion of the aerosol conduit 121 does not include a ventilation opening in the illustrated embodiment. Instead, the accelerating element 114 comprises a ventilation opening 130. In particular, the accelerating element 114 is a nozzle. A hose 120 is in fluid communication with the aerosol conduit 121. A mouthpiece 122 is coupled to hose 120 for a user of the device 100.

Figure 4:
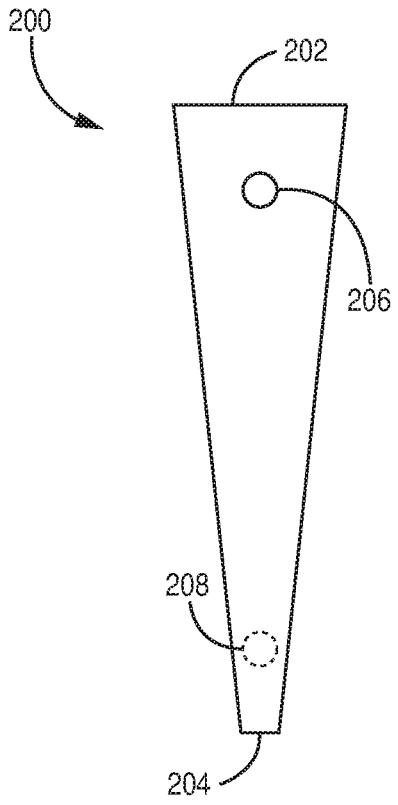
FIG. 4 is a schematic illustration of an accelerating element for use with the shisha device of FIG. 3.

FIG. 4 shows an accelerating element 200 for use with the shisha device 100. In particular, the accelerating element 200 may be positioned along the aerosol conduit 121. The accelerating element 200 is configured to accelerate aerosol that flows through the accelerating element. The accelerating element 200 includes one or more ventilation apertures of ventilation opening 206. The accelerating element 200 extends from a proximal opening of a proximal end portion 202 of the accelerating element 200 to a distal opening of a distal end portion 204 of the accelerating element 200. A ventilation opening 206 is positioned between the proximal and distal end portions 202, 204. In some embodiments, for example the embodiment shown in FIG. 4, the ventilation opening 206 is positioned relatively closer to the proximal opening of the accelerating element 200, which is located proximate to the aerosol-generating element 11 of the shisha device 100 when the accelerating element 200 is installed. Alternatively, the accelerating element 200 may be provided in a different location 208. The location 208 may be a location relatively closer to the distal opening of the accelerating element 200. The location 208 may be a relatively narrow end region of the accelerating element 200. In the illustrated embodiment, the accelerating element 200 is tapered. In some embodiments, a ratio between the total aperture area of the ventilation opening 206, 208 and a transverse cross-sectional area taken through the accelerating element at a central point of the aperture area of the ventilation opening 206, 208 is at most about 1:1000.

Figure 5:
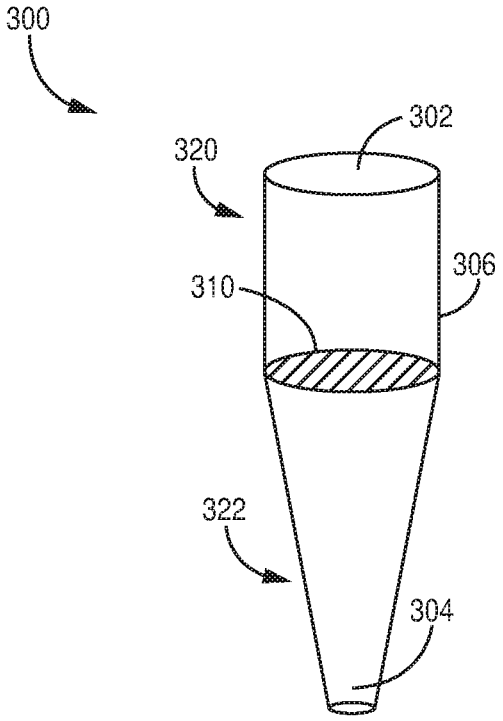
FIG. 5 is a schematic illustration of an alternative accelerating element for use with the shisha device of FIG. 3.

FIG. 5 shows an alternative accelerating element 300 for use with the shisha device 100. The accelerating element 300 extends from a proximal opening of a proximal end portion 302 of the accelerating element 300 to a distal opening of a distal end portion 304 of the accelerating element 300. A ventilation opening 306 is positioned between the proximal and distal end portions 202, 204. The accelerating element 300 differs from the accelerating element 200 of FIG. 4 in that only part of the accelerating element 300 is tapered. The accelerating element 300 includes a non-tapered portion 320 and a tapered portion 322 positioned distal to the non-tapered portion. The ventilation opening 306 is positioned on a non-tapered portion 320 of the accelerating element 300. The non-tapered portion 320 of the accelerating element 300 may define a transverse cross-sectional area 310 of the aerosol conduit 121 of shisha device 100 at a central point of the aperture area of the ventilation opening 306. In one embodiment, a ratio between the total aperture area of the ventilation opening 306 and the transverse cross-sectional area 310 is at most about 1:1000.

Figure 6:
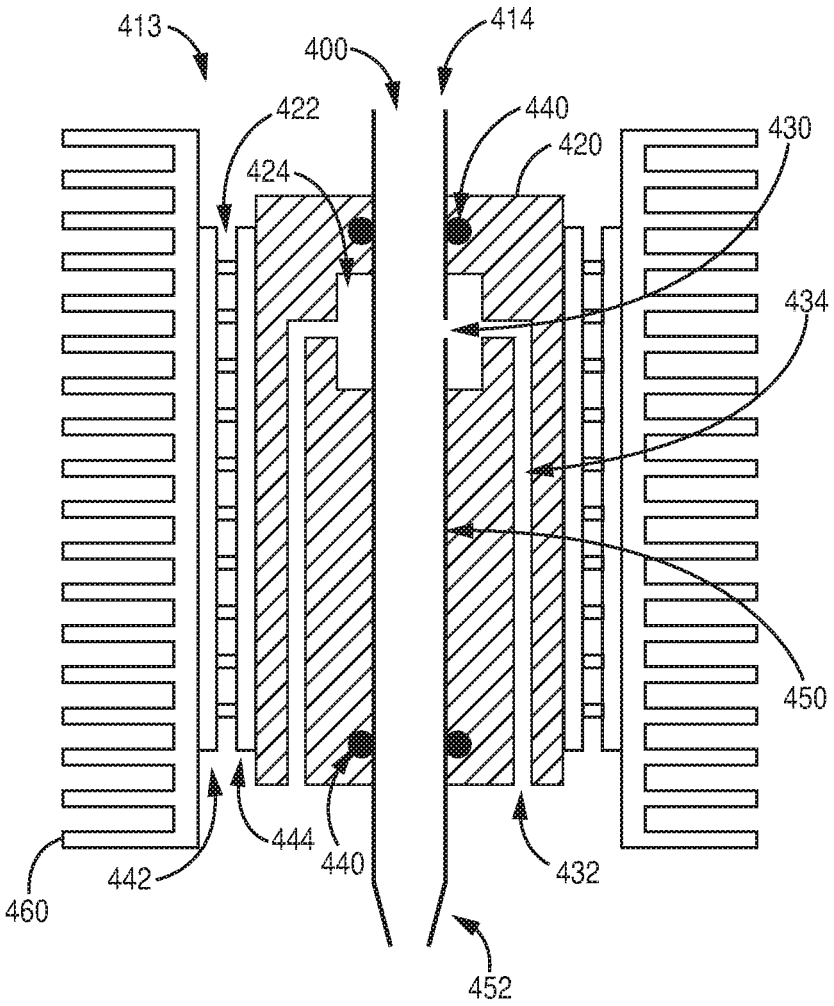
FIG. 6 is a schematic illustration of an aerosol conduit and a ventilation chamber for use with the shisha device of FIG. 3.

FIG. 6 shows part of an aerosol conduit 400 and a cooling element 413 that may be used with the shisha device 100. The aerosol conduit 400 includes an accelerating element 414. The accelerating element 414 includes a non-tapered portion 450 and a tapered portion 452 distal to the non-tapered portion. The non-tapered portion 450 may be referred to as a stem pipe or at least a proximal portion of the stem pipe. An internal diameter of the aerosol conduit 400 in the non-tapered portion 450 may be in a range between about 10 mm and about 11 mm. An internal diameter of a narrowest portion of the tapered portion 452 may be about 3 mm. A ventilation aperture 430 is provided along the non-tapered portion 450 of the accelerating element 414. The ventilation aperture 430 is in fluid communication with an ambient air aperture 432 via a ventilation chamber 424 and a ventilation channel 434. Ambient air may enter the ambient air aperture 432, travel through ventilation channel 434, and enter ventilation chamber 424. The ventilation aperture 430 may be about 1 mm in diameter.

The temperature of aerosol entering the aerosol conduit 400 from an aerosol-generating element of the shisha device 100 may be about 160° C. to about 200° C. The cooling element 413 may be used to cool the aerosol to promote the aerosolization process. In addition, the temperature of ventilation air pulled through the ventilation aperture 430 may be regulated using cooling element 413. Pre-cooling the ventilation air may further promote the aerosolization process. Pre-cooling the ventilation air additionally provides increased control over the temperature of the incoming ventilation air and thus over the reproducibility of the aerosolization performance.

The cooling element 413 includes a passive cooling element 420 and an active cooling element 422. The passive cooling element 420 comprises a cooling block, such as an aluminium cooling block. The active cooling element 422 comprises heat pumps (Peltier elements). The Peltier elements each comprise a hot side 442 and a cold side 444. The hot side 442 is thermally coupled to a heatsink comprising plurality of fins 460. The cold side 444 is thermally coupled to the passive cooling element 420. The Peltier element is configured to transfer heat from the cold side 444 to the hot side 442 in a direction away from the cooling block. Ambient air passing the heatsink is heated, drawing heat away from the cooling element 413. The preheated ambient air may enter the aerosol-generating element 11 of the shisha device 100 via an inlet. Ambient airflow entering the ventilation aperture 430 after first entering the cooling element 413 via the ambient air aperture 432 may provide efficient cooling of an aerosol flowing through the aerosol conduit 400. The cooling element 413 may be configured to cool ambient air entering via the ambient air aperture at about 1° C. per Watt using the Peltier elements. Further, a pair of fans (not shown) may be attached to the heatsinks for even further cooling.

In addition, using Peltier elements to pre-cool the ventilation air may reduce the temperature of a ventilation air stream to values below about 20° C. while still maintaining a power consumption of about 10 W, which facilitates compatibility of the shisha device 100 with a battery power source. The high temperature of the hot side 442 of the Peltier element can be reduced by dissipation using the heatsink.

As illustrated, two sealing gaskets 440 extend around the stem pipe 450. The sealing gaskets 440 are positioned between the non-tapered portion 450 of the accelerating element 414 (for example, the stem pipe) and the cooling element 413. In particular, the sealing gaskets 440 are placed at the proximal and distal portions of the cooling block to seal the non-tapered portion 450 (or stem pipe) surrounded by the cooling block to prevent dilution of generated aerosol.

The passive cooling element 420 defines a ventilation chamber 424 and a ventilation channel 434. The ventilation aperture 430 is in fluid communication with the ambient air aperture 432 via the ventilation chamber 424 and the ventilation channel 434. The ventilation chamber 424 may act as a temperature regulated air chamber. The ventilation chamber 424 extends around the ventilation aperture 430. In this embodiment, the ventilation opening is defined by the ventilation aperture 430, the ventilation chamber 424, the ventilation channel 434, and the ambient air aperture 432. Ambient air enters the ventilation channel 434 through the ambient air aperture 432 and flows towards the ventilation chamber 424. The ambient air may be cooled on its way to the chamber by one or more components of the cooling element 413. For example, the ambient air may be cooled by the cooling block. One or both of the ventilation channel 424 and the ventilation channel 434 may comprise a thread like geometry. The thread like geometry further promotes cooling of the ambient air. The ambient air, which may be cooled to about 15° C., for example, remains stagnant in the ventilation chamber 424 between puffs. When a user draws on the mouthpiece 122 of the shisha device 100, the ambient air in the ventilation channel 434 is drawn from the ventilation chamber 424, through the ventilation aperture 430 to the aerosol conduit. At the same time, the negative pressure generated by the user drawing on the mouthpiece 122 of the shisha device causes aerosol generated at the aerosol-generating element 11 to flow through the proximal opening 124 to the distal opening 126 of the aerosol conduit. Ventilation air may mix with aerosol-entrained air in the aerosol conduit 400 before passing through the accelerating element 414. This cools the aerosol, promoting the aerosolization process.

Using the temperature regulated ventilation chamber 424 may advantageously help to compensate for hotter ambient air around the shisha device, for example, up to about 45° C. (for example, in warmer climates, where shisha device is likely to be used). In some embodiments, the shisha device 100 using the aerosol conduit 400 may be used in ambient temperatures in a range between about 15° C. and about 45° C.

Examples of the shisha device with a ventilation opening were made and tested for aerosol production and compared to a shisha device without a ventilation opening. A cartridge filled with 10 g of commercially-available Al-Fakher molasses was heated using a wound-wire heating element set at a constant temperature of 200 degree Celsius. The wound-wire element included a ceramic cylinder having an internal diameter of 27.99±0.01 mm, a length of 41.5 mm, and a thickness of ceramic of 3 mm. The ceramic was obtained from Corning GmbH, Wiesbaden, Germany, under the trade designation "MACOR." A nozzle made of high temperature epoxy resin with an exit orifice of ϕ about 3 mm was placed at about 55 mm from the heating engine. The epoxy resin was a high temperature epoxy resin obtained from Formlabs, Berlin, Germany. The created aerosol was collected using a total of five Cambridge pads (92 mm diameter) whose was is recorded before and after the smoking experience. The total duration of the experiment corresponded to simulating 105 puffs. In order to achieve the desired puffing experience, four programmable dual syringe pumps (PDSP) manufactured by Pomac BV (Tolbert, Groninen, Netherlands) were used simultaneously to create the following puffing regime:

Puff volume: 530 mL

Puff duration: 2600 ms

Duration between puffs: 17 s

The ventilation aperture consisted of one single hole with a diameter of 1 mm having a total aperture area of about 0.8 $mm^2$. The aperture was placed at a distance of about 40 mm from the bottom of the heating engine.

The experimental setup was arranged such that only one of the five Cambridge pads collected the generated aerosol at a given moment. Every 21 puffs, a check valve was used to divert the aerosol to the correct Cambridge pad. As a consequence, the production of aerosol can be monitored as a function of time.

Figure 7:
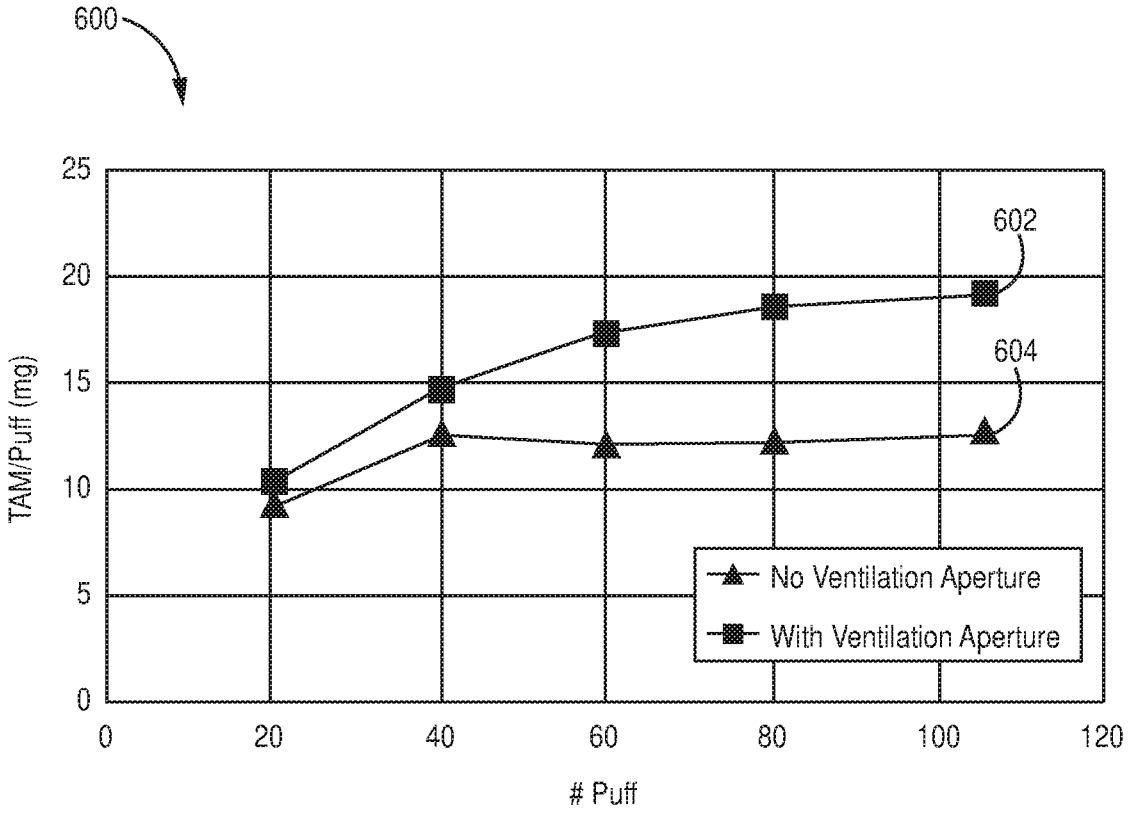
FIG. 7 is a graph showing total aerosol mass for a shisha device having a ventilation opening compared to a shisha device without a ventilation opening.

FIG. 7 shows a graph 600 of TAM for a shisha device having a ventilation opening 602 compared to TAM for a shisha device without a ventilation opening 604. Using the ventilation opening significantly increased the amount of visible smoke, from a total TAM of 1250 mg to 1700 mg.

The specific embodiments described above are intended to illustrate the invention. However, other embodiments may be made without departing from the scope of the invention as defined in the claims, and it is to be understood that the specific embodiments described above are not intended to be limiting.

As used herein, the singular forms "a," "an," and "the" encompass embodiments having plural referents, unless the content clearly dictates otherwise.

As used herein, "or" is generally employed in its sense including "and/or" unless the content clearly dictates otherwise. The term "and/or" means one or all the listed elements or a combination of any two or more of the listed elements.

As used herein, "have," "having," "include," "including," "comprise," "comprising" or the like are used in their open-ended sense, and generally mean "including, but not limited to". It will be understood that "consisting essentially of," "consisting of," and the like are subsumed in "comprising," and the like.

The words "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful and is not intended to exclude other embodiments from the scope of the disclosure, including the claims.

The invention claimed is:

1. A shisha device comprising:

an aerosol-generating element for receiving an aerosol-forming substrate;

the aerosol-generating element configured such that the temperature provided is sufficient to generate an aerosol without combusting or burning the aerosol-forming substrate;

a vessel spaced from the aerosol-generating element and defining an interior for housing a volume of liquid, the vessel comprising a head space outlet; and an aerosol conduit positioned between the aerosol-generating element and the interior of the vessel, the aerosol conduit comprising:

a proximal end portion defining a proximal opening positioned to receive airflow from the aerosol-generating element;

a distal end portion defining a distal opening positioned in the interior of the vessel; and a ventilation opening positioned between the proximal and distal end portions, wherein the ventilation opening comprises one or more ventilation apertures and wherein the one or more ventilation apertures have a total aperture area;

wherein a ratio between the total aperture area of the ventilation opening and a transverse cross-sectional area of the aerosol conduit positioned proximate to the ventilation opening is at most 1:1000; and wherein applying a negative pressure at the head space outlet causes airflow through the aerosol conduit from the proximal opening downstream to the distal opening and causes ambient air to flow from the ventilation opening, through the aerosol conduit, to the distal opening of the aerosol conduit.

2. The shisha device of claim 1, wherein the ventilation opening comprises one or more:

a ambient air aperture.

3. The shisha device of claim 2, wherein the aerosol conduit comprises a cooling element positioned proximate to the one or more ambient air aperture.

4. The shisha device of claim 3, wherein the cooling element comprises an active cooling element.

5. The shisha device of claim 1, wherein the aerosol conduit comprises an accelerating element positioned along the aerosol conduit and configured to accelerate aerosol that flows through the accelerating element.

6. The shisha device of claim 5, wherein the accelerating element comprises one or more ventilation apertures of the ventilation opening.

7. The shisha device of claim 5, wherein the accelerating element comprises a tapered portion and the ventilation opening is positioned in a relatively narrower end portion of the tapered portion of the accelerating element.

8. The shisha device of claim 1, wherein the ventilation opening comprises one or more ventilation apertures forming a ring-shaped opening.

9. The shisha device of claim 1, wherein the ventilation opening comprises a ventilation chamber in fluid communication with one or more ventilation apertures of the ventilation opening.

10. The shisha device of claim 9, wherein the ventilation chamber comprises a vortex element.

11. The shisha device of claim 1, wherein the aerosol conduit comprises a cooling element configured to cool aerosol that flows through the cooling element.

12. The shisha device of claim 11, wherein the cooling element defines at least one of an ambient air aperture of the ventilation opening and a ventilation chamber adjacent to a ventilation aperture of the ventilation opening.

13. The shisha device of claim 1, wherein the ventilation opening comprises one or more ventilation apertures having a total aperture area between 0.2 $mm^2$ and 7 $mm^2$.

14. The shisha device of claim 1, wherein the transverse cross-sectional area is located in line with a central point of the ventilation opening.

15. The shisha device of claim 1, wherein the aerosol-generating element and the centre of the ventilation opening are separated by no more than 30 mm.

16. The shisha device of claim 1, wherein the device increases visible aerosol, total aerosol mass, or visible aerosol and total aerosol mass relative to a device that does not include the ventilation opening.

* * * * *